US011672393B2

(12) United States Patent
Freese et al.

(10) Patent No.: US 11,672,393 B2
(45) Date of Patent: Jun. 13, 2023

(54) CLEANING APPARATUS WITH SELECTABLE COMBING UNIT FOR REMOVING DEBRIS FROM CLEANING ROLLER

(71) Applicant: SHARKNINJA OPERATING LLC, Needham, MA (US)

(72) Inventors: John B. Freese, Chestnut Hill, MA (US); Nicholas Sardar, London (GB); Tyler S. Smith, Boston, MA (US)

(73) Assignee: SharkNinja Operating LLC, Needham, MA (US)

( * ) Notice: Subject to any disclaimer, the term of this patent is extended or adjusted under 35 U.S.C. 154(b) by 955 days.

(21) Appl. No.: 16/229,363

(22) Filed: Dec. 21, 2018

(65) Prior Publication Data

US 2019/0191947 A1 Jun. 27, 2019

Related U.S. Application Data

(63) Continuation-in-part of application No. 15/917,598, filed on Mar. 10, 2018, now Pat. No. 10,925,447.
(Continued)

(51) Int. Cl.
*A47L 9/04* (2006.01)
*A47L 5/30* (2006.01)

(52) U.S. Cl.
CPC ..... *A47L 9/0488* (2013.01); *A47L 5/30* (2013.01); *A47L 9/0444* (2013.01); *A47L 9/0477* (2013.01)

(58) Field of Classification Search
CPC . A47L 9/0477; A47L 11/4094; A47L 11/4041
See application file for complete search history.

(56) References Cited

U.S. PATENT DOCUMENTS 2,587,038 A 2/1952 Goodell
2,960,714 A 11/1960 Senne
(Continued)

FOREIGN PATENT DOCUMENTS

CN 1887171 1/2007
CN 105982615 A 10/2016
(Continued)

OTHER PUBLICATIONS

Canadian Office Action dated Mar. 4, 2020, received in Canadian Patent Application No. 3,036,354, 4 pgs.
(Continued)

*Primary Examiner* — Bryan R Muller
(74) *Attorney, Agent, or Firm* — Grossman Tucker Perreault & Pfleger, PLLC

(57) ABSTRACT

A cleaning apparatus comprising a housing, at least one agitator configured to be rotatably coupled to the housing, a combing unit comprising a plurality of spaced teeth configured to contact the agitator for preventing build up and removing debris, and a switch configured to cause the combing unit to move between an active mode in which the plurality of spaced teeth are configured to contact the agitator for preventing build up and removing debris, and an inactive mode in which the plurality of spaced teeth are configured to not contact the agitator. The switch may be configured to cause the combing unit to rotate about a pivot axis between the active mode and the inactive mode. The switch may be configured to convert linear motion of the switch into the rotational motion of the combing unit about the pivot axis.

8 Claims, 32 Drawing Sheets

Related U.S. Application Data

(60) Provisional application No. 62/717,309, filed on Aug. 10, 2018, provisional application No. 62/610,733, filed on Dec. 27, 2017.

(56) References Cited

U.S. PATENT DOCUMENTS

| | | | | |
|---|---|---|---|---|
| 3,612,052 | A | 10/1971 | Krummenacher | |
| 3,737,937 | A | 6/1973 | Nordeen | |
| 4,177,536 | A | 12/1979 | Powers | |
| 4,955,107 | A | 9/1990 | Kawai | |
| 5,435,038 | A | 7/1995 | Sauers | |
| 5,482,562 | A | 1/1996 | Abernathy | |
| 5,495,634 | A | 3/1996 | Brundula et al. | |
| 6,170,119 | B1 | 1/2001 | Conrad et al. | |
| 6,539,575 | B1 | 4/2003 | Cohen | |
| 6,892,420 | B1 | 5/2005 | Haan et al. | |
| 7,007,336 | B2 | 3/2006 | Roney et al. | |
| 7,690,079 | B2 * | 4/2010 | Boddy | A47L 9/0444 15/389 |
| 7,979,952 | B2 | 7/2011 | Beskow et al. | |
| 8,060,967 | B1 | 11/2011 | Johnson, Jr. | |
| 8,083,167 | B1 | 12/2011 | Namakian et al. | |
| 8,087,117 | B2 | 1/2012 | Kapoor et al. | |
| D680,289 | S | 4/2013 | Gray et al. | |
| 8,418,303 | B2 | 4/2013 | Kapoor et al. | |
| 8,505,158 | B2 | 8/2013 | Han et al. | |
| 8,572,799 | B2 | 11/2013 | Won et al. | |
| 8,601,643 | B2 | 12/2013 | Eriksson | |
| 8,671,515 | B2 | 3/2014 | Eriksson | |
| 9,072,416 | B2 | 7/2015 | Kowalski | |
| 9,192,273 | B2 | 11/2015 | Eriksson | |
| 9,295,362 | B2 | 3/2016 | Eriksson | |
| 9,295,364 | B2 | 3/2016 | Eriksson | |
| 9,314,140 | B2 * | 4/2016 | Eriksson | A47L 9/30 |
| 9,320,398 | B2 | 4/2016 | Hussey et al. | |
| 9,375,122 | B2 | 6/2016 | Eriksson | |
| 9,480,374 | B2 | 11/2016 | Li et al. | |
| 9,492,048 | B2 | 11/2016 | Won et al. | |
| 9,615,708 | B2 | 4/2017 | Kowalski | |
| 9,775,477 | B2 | 10/2017 | Eriksson | |
| 9,820,624 | B2 | 11/2017 | Eriksson | |
| 9,820,626 | B2 | 11/2017 | Eriksson et al. | |
| 9,833,115 | B2 | 12/2017 | Eriksson | |
| 9,839,335 | B2 | 12/2017 | Eriksson | |
| 1,031,449 | A1 | 6/2019 | Blouin | |
| 11,109,735 | B2 * | 9/2021 | Gunter | A47L 9/0477 |
| 2003/0204923 | A1 | 11/2003 | Nakamura | |
| 2006/0042042 | A1 | 3/2006 | Mertes et al. | |
| 2006/0053584 | A1 | 3/2006 | Dever | |
| 2007/0209147 | A1 | 9/2007 | Krebs et al. | |
| 2008/0115736 | A1 | 5/2008 | Porter et al. | |
| 2010/0011529 | A1 | 1/2010 | Won et al. | |
| 2010/0313912 | A1 | 12/2010 | Han et al. | |
| 2011/0252594 | A1 | 10/2011 | Blouin | |
| 2013/0007982 | A1 | 1/2013 | Yun | |
| 2013/0042429 | A1 | 2/2013 | Misumi et al. | |
| 2013/0198995 | A1 | 8/2013 | Eriksson | |
| 2014/0053351 | A1 | 2/2014 | Kapoor et al. | |
| 2014/0143978 | A1 | 5/2014 | Li et al. | |
| 2014/0259522 | A1 | 9/2014 | Kasper et al. | |
| 2014/0359968 | A1 * | 12/2014 | Eriksson | A47L 9/0477 15/390 |
| 2014/0366300 | A1 * | 12/2014 | Eriksson | A46B 17/06 15/246.2 |
| 2015/0230676 | A1 | 8/2015 | Eriksson | |
| 2015/0313431 | A1 | 11/2015 | Eriksson | |
| 2015/0342430 | A1 | 12/2015 | Kasper et al. | |
| 2016/0058257 | A1 | 3/2016 | Ventress et al. | |
| 2016/0166052 | A1 | 6/2016 | Kasper et al. | |
| 2016/0220082 | A1 | 8/2016 | Thorne et al. | |
| 2016/0220084 | A1 | 8/2016 | Xu et al. | |
| 2017/0172363 | A1 | 6/2017 | Eriksson et al. | |
| 2017/0172364 | A1 | 6/2017 | Eriksson | |
| 2017/0311767 | A1 | 11/2017 | Fang | |
| 2018/0070785 | A1 | 3/2018 | Udy et al. | |
| 2020/0046183 | A1 | 2/2020 | Choi et al. | |

FOREIGN PATENT DOCUMENTS

| | | | |
|---|---|---|---|
| CN | 205671990 | U | 11/2016 |
| CN | 107233047 | A | 10/2017 |
| DE | 102007006654 | A1 | 8/2008 |
| DE | 102019106501 | A1 | 9/2020 |
| EP | 2543301 | | 1/2013 |
| EP | 2570067 | | 3/2013 |
| GB | 583738 | | 12/1946 |
| GB | 2310213 | A | 8/1997 |
| JP | S62155812 | A | 7/1987 |
| KR | 1020130107152 | A | 7/1987 |
| KR | 1020170111688 | A | 10/2017 |
| WO | 2009117383 | A2 | 9/2009 |
| WO | 2014095604 | A1 | 6/2014 |
| WO | 2014140872 | A2 | 9/2014 |
| WO | 2016030756 | A1 | 3/2016 |

OTHER PUBLICATIONS

US Office Action dated Apr. 29, 2020, received in U.S. Appl. No. 15/917,598, 12 pgs.

PCT Search Report and Written Opinion dated Aug. 24, 2018, received in corresponding PCT Application No. PCT/US18/34668, 7 pgs.

Canadian Examiners Report dated Nov. 6, 2020, received in Canadian Application No. 3,036,354, 4 pgs.

EP Search Report dated Dec. 1, 2020, received in EP Application No. 18763596.6, 7 pgs.

EP Search Report dated Nov. 26, 2020, received in EP Application No. 18806571.8, 7 pgs.

EP Search Report dated Nov. 26, 2020, received in EP Application No. 18894320.3, 6 pgs.

EP Search Report dated Nov. 25, 2020, received in EP Application No. 18897246.7, 7 pgs.

U.S. Office Action dated Nov. 13, 2020, received in U.S. Appl. No. 16/229,796, 14 pgs.

U.S. Office Action dated Feb. 19, 2021, received in U.S. Appl. No. 15/699,358, 17 pages.

Chinese Office Action with translation dated May 24, 2021, received in China Application No. 201780055478.6, 8 pgs.

Chinese Office Action with English translation dated Jun. 3, 2021, received in Chinese Patent Application No. 201880090257.7, 16 pages.

UK Examination Report dated Jul. 8, 2021, received in U.K. Patent Application No. GB1903295.2, 2 pages.

PCT Search Report and Written Opinion dated May 3, 2019, received in corresponding PCT Application No. PCT/US18/67163, 14 pgs.

U.S. Office Action dated May 1, 2019, received in U.S. Appl. No. 15/699,358, 26 pgs.

PCT International Search Report and Written Opinion dated Jun. 6, 2018, received in corresponding PCT Application No. PCT/US18/21888, 12 pgs.

PCT Search Report and Written Opinion dated Dec. 20, 2017, received in corresponding PCT Application No. PCT/US17/50691, 11 pgs.

PCT Search Report and Written Opinion dated Mar. 5, 2019, received in corresponding PCT Application No. PCT/US18/67171, 8 pgs.

Canadian Office Action dated Aug. 13, 2021, received in Canadian Patent Application No. 3,036,354, 3 pages.

Chinese Office Action with English translation dated Aug. 18, 2021, received in Chinese Patent Application No. 201880090292.9, 11 pages.

Chinese Decision of Rejection with English translation dated Sep. 3, 2021, received in Chinese Patent Application No. 201780055478.6, 7 pages.

(56) References Cited

OTHER PUBLICATIONS

Chinese Office Action with English translation dated Apr. 27, 2021, received in Chinese Patent Application No. 201880023329.6, 13 pages.
UK Examination Report dated Nov. 16, 2021, received in UK Patent Application No. GB1 903295.2, 2 pages.
Chinese Office Action with English translation dated Mar. 2, 2022, received in Chinese Patent Application No. 202110308172.5, 11 pages.
Chinese Office Action with English translation dated Apr. 1, 2022, received in Chinese Patent Application No. 201880090257.7, 6 pages.
Japanese Office Action with English translation dated Apr. 21, 2022, received in Japanese Patent Application No. 2021-075166, 7 pages.
Chinese Office Action with English Summary dated Sep. 16, 2022, received in Chinese Patent Application No. 202111652130.X, 12 pages.
Chinese Office Action with English Summary dated Oct. 12, 2022, received in Chinese Patent Application No. 202110308172.5, 9 pages.
U.S. Office Action dated Nov. 18, 2022, received in U.S. Appl. No. 17/170,331, 9 pages.
Chinese Office Action with English translation dated May 22, 2020, received in Chinese Patent Application No. 201880043227.0, 8 pgs.
Chinese Office Action with translation dated Sep. 1, 2020, received in Chinese Application No. 201880023329.6, 12 pgs.
Chinese Office Action with translation dated Sep. 1, 2020, received in Chinese Application No. 201780055478.6, 10 pgs.
U.S. Office Action dated Jun. 17, 2020, received in U.S. Appl. No. 15/699,358, 16 pgs.
Australian Office Action dated Dec. 20, 2022, received in Australian Patent Application No. 2021202946, 4 pages.
European Examination Report dated Jan. 17, 2023, received in European Patent Application No. 18897246.7, 4 pages.
U.S. Office Action dated Mar. 27, 2023, received in U.S. Appl. No. 17/182,090, 15 pages.

* cited by examiner

CLEANING APPARATUS WITH SELECTABLE COMBING UNIT FOR REMOVING DEBRIS FROM CLEANING ROLLER

CROSS-REFERENCE TO RELATED APPLICATIONS

The present disclosure claims the benefit of U.S. Provisional Patent Application Ser. No. 62/717,309 filed Aug. 10, 2018, and U.S. Provisional Patent Application Ser. No. 62/610,733 filed Dec. 27, 2017, both of which are fully incorporated herein by reference. The present application is also a continuation-in-part of U.S. patent application Ser. No. 15/917,598, filed Mar. 10, 2018, which is fully incorporated herein by reference.

TECHNICAL FIELD

The present disclosure relates to cleaners with cleaning rollers/agitators and more particularly, to a cleaning apparatus, such as a surface cleaning head for a vacuum cleaner, with a combing unit for removing debris from a cleaning roller/agitator which can be selected between an active mode and an inactive mode.

BACKGROUND INFORMATION

Vacuum cleaners generally include a suction conduit with an opening on the underside of a surface cleaning head for drawing air (and debris) into and through the surface cleaning head. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Vacuum cleaners also generally use agitation to loosen debris and facilitate capturing the debris in the flow of air into the suction conduit. Agitators are often used in the suction conduit of a surface cleaning head proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the surface cleaning head may push larger debris forward without ever allowing the debris to be captured in the flow into the suction conduit (sometimes referred to as snowplowing).

One example of an agitator is a cleaning roller such as a brush roll. A cleaning roller may be located within a suction conduit and/or may be located at a leading side of a suction conduit (e.g., a leading roller). One challenge with a leading roller in particular is the debris (e.g., hair) that becomes entangled around the roller. Projections may be used to engage the roller to facilitate removal of debris, but existing structures are often not effective and/or interfere with the operation of the surface cleaning head.

One solution to generally reduce and/or prevent debris from becoming entangled around the roller is to include a debriding rib/combing unit. The debriding rib/combing unit may include a plurality of teeth that contact and cut the debris on the roller as the roller rotates past the debriding rib/combing unit. In some embodiments, a portion of the roller may also contact the plurality of teeth of the debriding rib/combing unit. While the debriding rib/combing unit is effective at generally reducing and/or preventing debris from becoming entangled around the roller, the contact between the roller and the plurality of teeth of the debriding rib/combing unit may cause unwanted noise and/or vibration. As such, there exists a need for device that can generally reduce and/or prevent debris from becoming entangled around the roller while also minimizing and/or eliminating undesired noise and/or vibration.

BRIEF DESCRIPTION OF THE DRAWINGS

These and other features and advantages will be better understood by reading the following detailed description, taken together with the drawings wherein.

DETAILED DESCRIPTION

Figure 1:
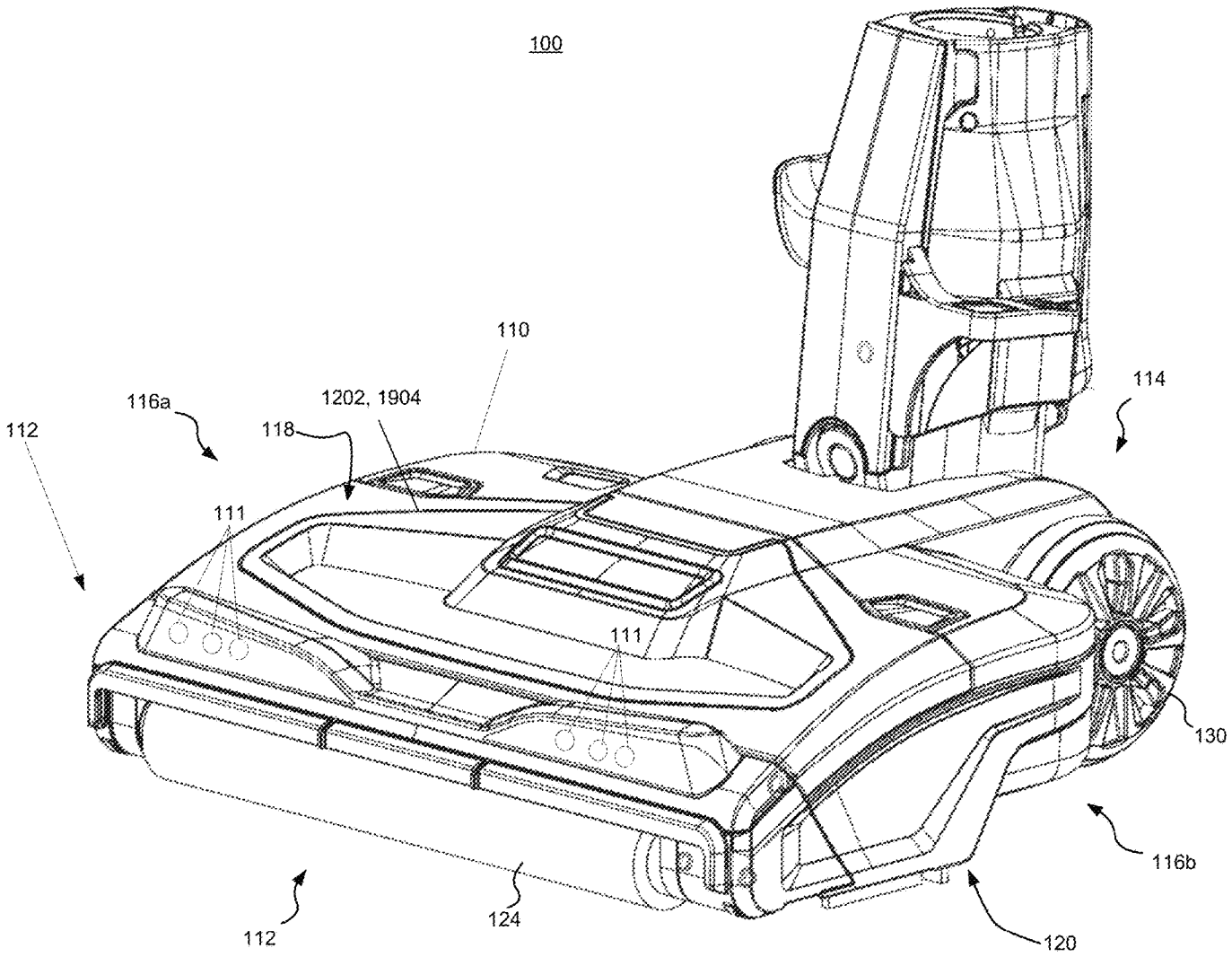
FIG. 1 is a perspective view of a surface cleaning head including dual agitators, combing protrusions, and an isolator, consistent with an embodiment of the present disclosure.

A cleaning apparatus, consistent with at least one aspect of the present disclosure, includes a housing, at least one agitator configured to be rotatably coupled to the housing, a combing unit comprising a plurality of spaced teeth configured to contact the agitator for preventing build up and removing debris, and an switch configured to cause the combing unit to move between an active mode in which the plurality of spaced teeth are configured to contact the agitator for preventing build up and removing debris, and an inactive mode in which the plurality of spaced teeth are configured to not contact the agitator. Alternatively (or in addition), a cleaning apparatus, consistent with at least one aspect of the present disclosure, includes a housing, at least one agitator configured to be rotatably coupled to the housing, and a first panel configured to be removably coupled to the housing. The first panel includes a combing unit comprising a plurality of spaced teeth configured to contact the agitator when secured to the housing for preventing build up and removing debris. The surface cleaning head may also include at least one of a second panel configured to be removably coupled to the housing which does not include a combing unit, a third panel configured to be removably coupled to the housing which includes a combing unit comprising a plurality of spaced teeth which do not contact the agitator when secured to the housing, or the first panel in which the combing unit is configured to move between a first position in which the plurality of spaced teeth are configured to contact the agitator, and a second position in which the plurality of spaced teeth do not contact the agitator.

The combing unit (also referred to as a debriding unit or rib) may include one or more spaced protrusions or teeth extending into a cleaning roller (e.g., agitator) for preventing build up and removing debris (such as hair, string, and the like). The protrusions may extend along a substantial portion of the cleaning roller and extend partially into the cleaning roller to intercept the debris as it passes around the roller. The protrusions may have angled leading edges that are not aligned with a rotation center of the cleaning roller and are directed into or against a direction of rotation of the cleaning roller. The combing unit and protrusions may have a shape and configuration designed to facilitate debris removal from the cleaning roller with minimal impact on the operation of the cleaning apparatus. The cleaning apparatus may include a surface cleaning head of an upright vacuum cleaner or sweeper or a robotic vacuum cleaner.

The combing unit may be mounted, coupled, and/or otherwise secured to a portion of the clearing apparatus using one or more isolators. The isolators may comprise an elastomeric material configured to absorb at least some of the energy transmitted by the rotating roller as it rotates past and contacts the plurality of teeth of the debriding rib and convert the energy (e.g., vibrational energy). For example, the isolator may absorb at least some of the energy transmitted by the rotating roller into heat, thereby reducing the acoustical energy and/or transfer of vibrational energy to the cleaning apparatus (e.g., but not limited to, the nozzle casing). The isolators therefore significantly reduce the noise and/or vibration due to the interaction of the roller against the combing unit, which in turn improves the user experience.

Figure 10:
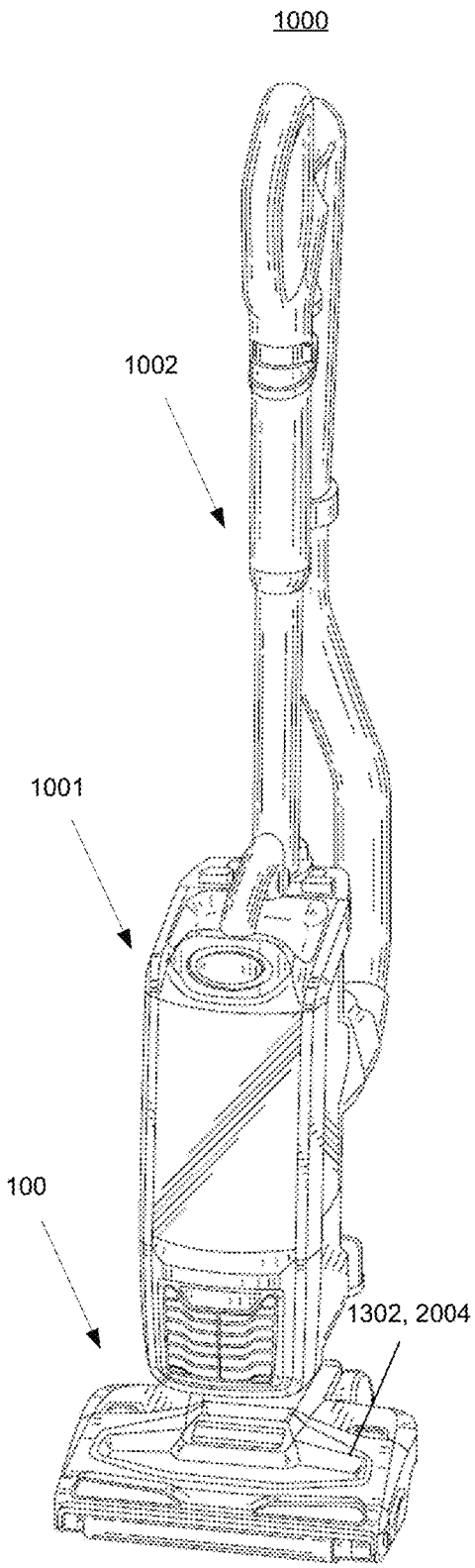
FIG. 10 is a perspective front view of an upright vacuum cleaner including the combing unit and isolator.
Figure 11:
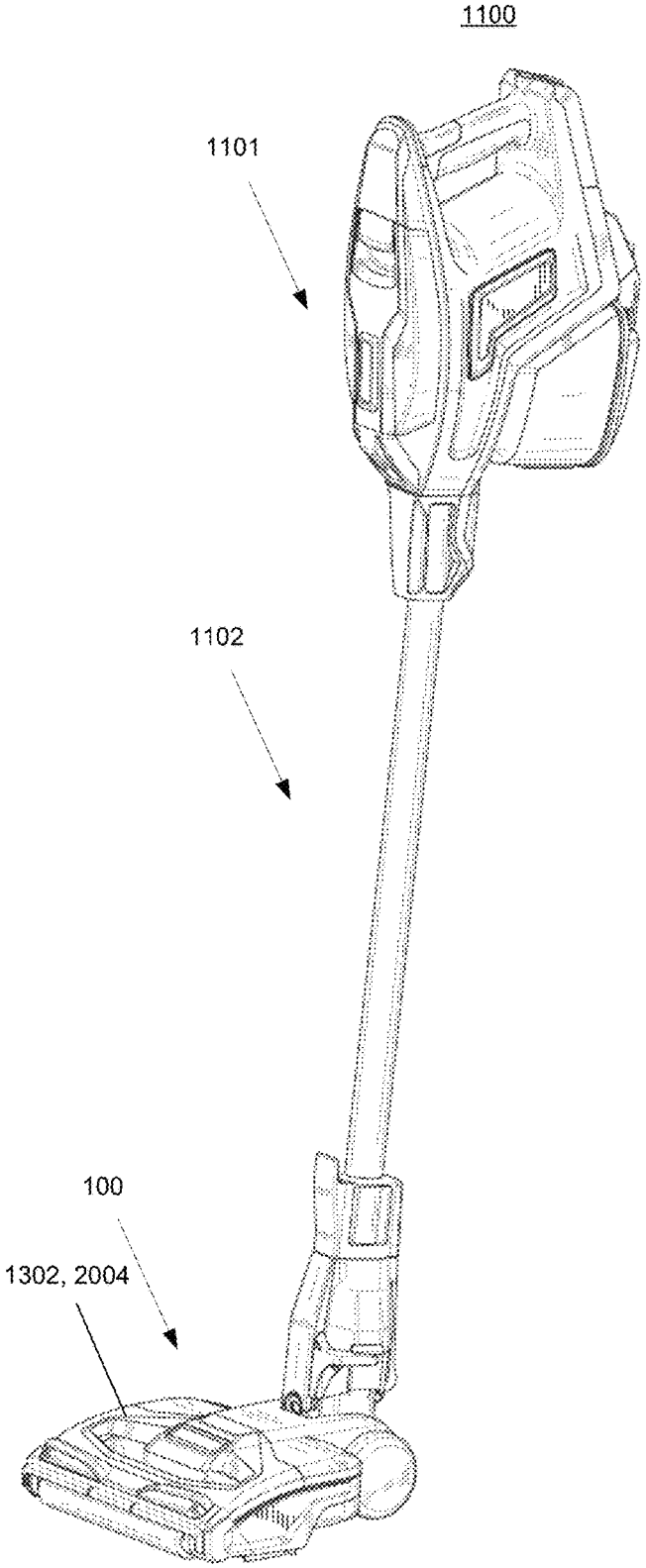
FIG. 11 is a perspective front view of a stick type vacuum cleaner including the combing unit and isolator.
Figure 12:
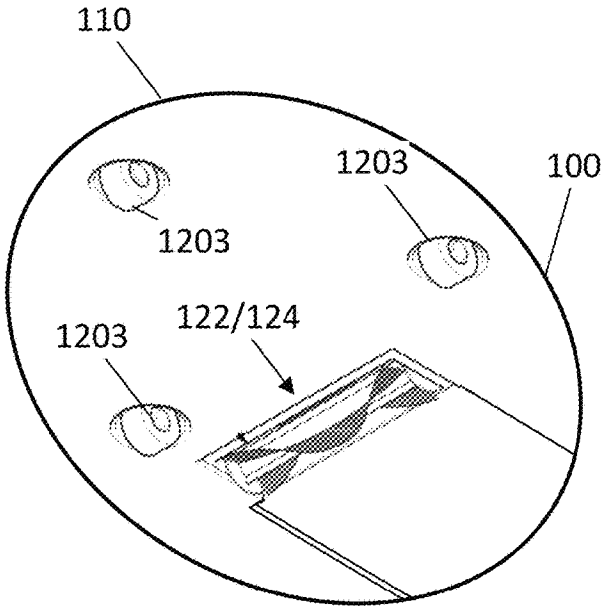
FIG. 12 is a perspective bottom view of a robot vacuum cleaner including the combing unit and isolator.

As used herein, the phrase "surface cleaning head" refers to a device configured to contact a surface for cleaning the surface by use of suction air flow, agitation, or a combination thereof. A surface cleaning head consistent with one or more aspects of the present disclosure may be used in different types of cleaning apparatuses (e.g., vacuum cleaners) including, without limitation, an "all in the head" type vacuums, upright vacuum cleaners, canister vacuum cleaners, stick vacuum cleaners, robotic vacuum cleaners and central vacuum systems, and may be used in sweepers (e.g., low or no suction), for example, as generally illustrated in FIGS. 10-11, as well as robotic vacuum cleaners, for example, as generally illustrated in FIG. 12. An example of a surface cleaning head used in a robotic vacuum cleaner is disclosed in greater detail in U.S. Provisional Application No. 62/469,853, filed Mar. 10, 2017, which is fully incorporated herein by reference.

A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a surface cleaning head. As used herein, "soft" and "softer" refer to the characteristics of a cleaning element being more compliant or pliable than another cleaning element. As used herein, the term "flow path" refers to the path taken by air as it flows into a suction conduit when drawn in by suction. As used herein, the terms "above" and "below" are used relative to an orientation of the surface cleaning head on a surface to be cleaned and the terms "front" and "back" are used relative to a direction that a user pushes the surface cleaning head on a surface being cleaned (i.e., back to front). As used herein, the term "leading" refers to a position in front of at least another component but does not necessarily mean in front of all other components.

Figure 2:
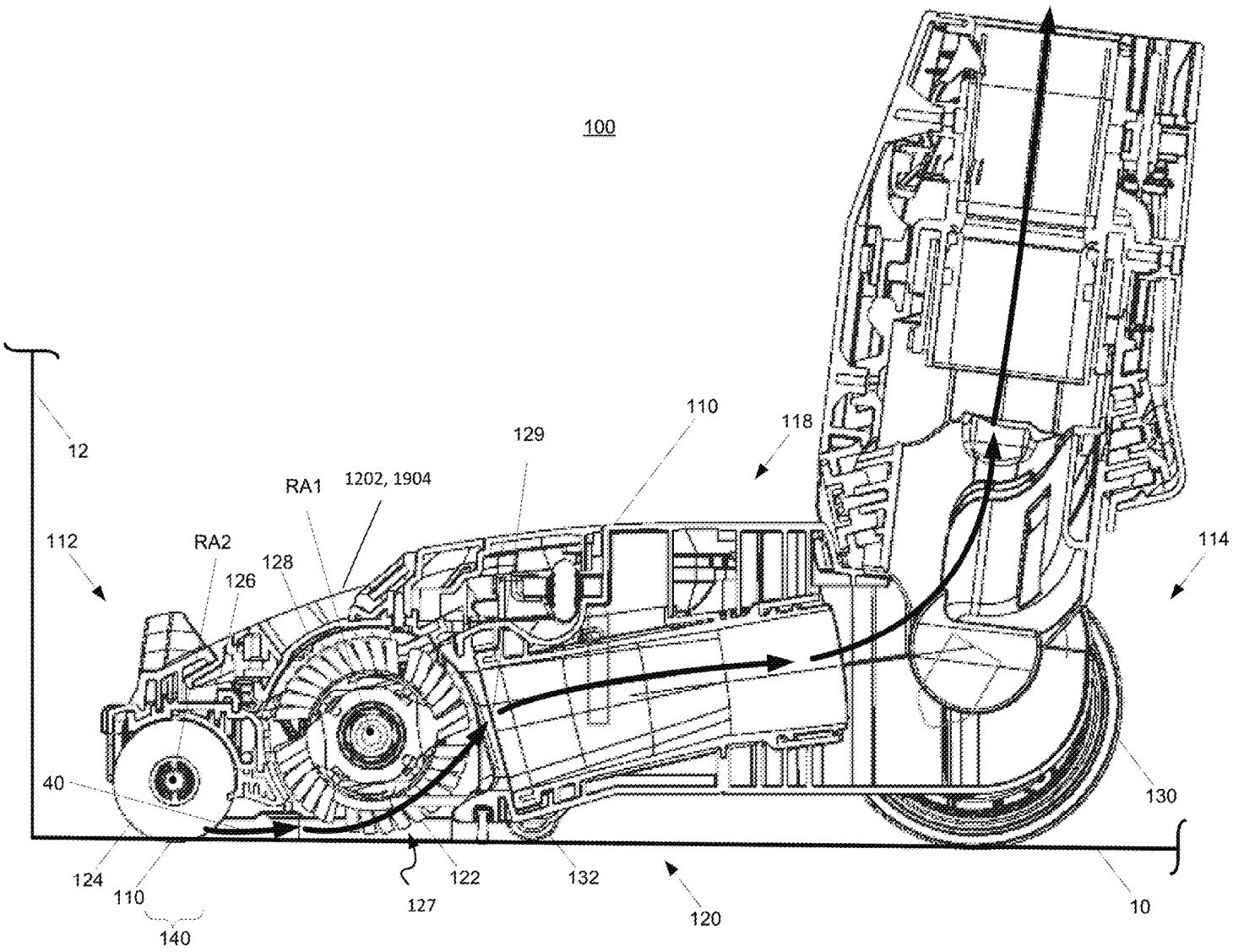
FIG. 2 is a side cross-sectional view of the surface cleaning head shown in FIG. 1 showing a flow path through a suction conduit.

Referring to FIGS. 1-2, one embodiment of a surface cleaning head 100 is generally illustrated. As noted herein, a surface cleaning head 100 may form part of a cleaning apparatus. The surface cleaning head 100 includes a housing 110 with a front side 112, and a back side 114, left and right sides 116*a*, 116*b*, an upper side 118, and a lower or underside 120. The housing 110 defines a suction conduit 128 having an opening 127 on the underside 120 of the housing 110 (shown in FIG. 2). The suction conduit 128 is fluidly coupled to a dirty air inlet 129, which leads to a suction motor (not shown) either in the surface cleaning head 100 or another location in the vacuum. The suction conduit 128 is the interior space defined by interior walls in the housing 110, which receives and directs air drawn in by suction, and the opening 127 is where the suction conduit 128 meets the underside 120 of the housing 110.

In the illustrated embodiment, the surface cleaning head 100 includes dual rotating agitators 122, 124, for example, a brush roll 122 and a leading roller 124. The brush roll 122 and leading roller 124 may be configured to rotate about first and second rotating axes (RA1, RA2). The rotating brush roll 122 is at least partially disposed within the suction conduit 128 (shown in FIG. 2). The leading roller 124 is positioned in front of and spaced from the brush roll 122 and at least substantially outside the suction conduit 128. In some embodiments, at least an inside upper portion (e.g., upper half) of the leading roller 124 is not exposed to the primary air flow path (e.g., arrow 40) into the opening 127 of the suction conduit 128 while at least an inside of the bottom portion of the leading roller 124 is exposed to the primary flow path into the opening 127 of the suction conduit 128.

Other variations are possible where different portions of the leading roller 124 may be exposed or not exposed to the flow path into the suction conduit 128. In other embodiments, for example, a flow path may allow air to flow over the upper portion of the leading roller 124. The leading roller 124 may rotate about the second rotation axis RA2 located within a leading roller chamber 126. The leading roller chamber 126 may have a size and shape slightly larger than the cylindrical projection of the leading roller 124 when the leading roller 124 is rotating therein, for example, to form the flow path over the upper portion. While FIGS. 1-2 illustrate a surface cleaning head 100 having dual rotating agitators 122, 124, it should be appreciated that a surface cleaning head 100 consistent with the present disclosure may include only a single rotating agitator or more than two agitators.

The surface cleaning head 100 may include one or more wheels 130 for supporting the housing 110 on the surface 10 to be cleaned. The brush roll 122 may be disposed in front of one or more wheels 130, 132 (see FIG. 1) for supporting the housing 110 on the surface 10 to be cleaned. For example, one or more larger wheels 130 may be disposed along the back side 114 and/or one or more smaller middle and/or front wheels 132 may be provided at a middle section and/or front section on the underside 120 of the housing 110 and/or along the left and right sides 116*a*, 116*b*. Other wheel configurations may also be used. The wheels 130, 132 facilitate moving the surface cleaning head 100 along the surface 10 to be cleaned, and may also allow the user to easily tilt or pivot the surface cleaning head 100 (e.g., brush roll 122 and/or the leading roller 124) off of the surface 10 to be cleaned. The rear wheel(s) 130 and the middle/front wheel(s) 132 may provide the primary contact with the surface being cleaned and thus primarily support the surface cleaning head 100. When the surface cleaning head 100 is positioned on the surface 10 being cleaned, the leading roller 124 may also rest on the surface 10 being cleaned. In other embodiments, the leading roller 124 may be positioned such that the leading roller 124 sits just above the surface being cleaned.

The rotating brush roll 122 may have bristles, fabric, or other cleaning elements, or any combination thereof around the outside of the brush roll 122. Examples of brush rolls and other agitators are shown and described in greater detail in U.S. Pat. No. 9,456,723 and U.S. Patent Application Pub. No. 2016/0220082, which are fully incorporated herein by reference.

The leading roller 124 may include a relatively soft material (e.g., soft bristles, fabric, felt, nap or pile) arranged in a pattern (e.g., a spiral pattern) to facilitate capturing debris, as will be described in greater detail below. The leading roller 124 may be selected to be substantially softer than that of the brush roll 122. The softness, length, diameter, arrangement, and resiliency of the bristles and/or pile of the leading roller 124 may be selected to form a seal with a hard surface (e.g., but not limited to, a hard wood floor, tile floor, laminate floor, or the like), whereas the bristles of the brush roll 122 may selected to agitate carpet fibers or the like. For example, the leading roller 124 may be at least 25% softer than the brush roll 122, alternatively the leading roller 124 may be at least 30% softer than the brush roll 122, alternatively the leading roller 124 may be at least 35% softer than the brush roll 122, alternatively the leading roller 124 may be at least 40% softer than the brush roll 122, alternatively the leading roller 124 may be at least 50% softer than the brush roll 122, alternatively the leading roller 124 may be at least 60% softer than the brush roll 122. Softness may be determined, for example, based on the pliability of the bristles or pile being used.

The size and shape of the bristles and/or pile may be selected based on the intended application. For example, the leading roller 124 may include bristles and/or pile having a length of between 5 to 15 mm (e.g., 7 to 12 mm) and may have a diameter of 0.01 to 0.04 mm (e.g., 0.01-0.03 mm). According to one embodiment, the bristles and/or pile may have a length of 9 mm and a diameter of 0.02 mm. The bristles and/or pile may have any shape. For example, the bristles and/or pile may be linear, arcuate, and/or may have a compound shape. According to one embodiment, the bristles and/or pile may have a generally U and/or Y shape. The U and/or Y shaped bristles and/or pile may increase the number of points contacting the floor surface 10, thereby enhancing sweeping function of leading roller 124. The bristles and/or pile may be made on any material such as, but not limited to, Nylon 6 or Nylon 6/6.

Optionally, the bristles and/or pile of leading roller 124 may be heat treated, for example, using a post weave heat treatment. The heat treatment may increase the lifespan of the bristles and/or pile of the leading roller 124. For example, after weaving the fibers and cutting the velvet into rolls, the velvet may be rolled up and then run through a steam rich autoclave making the fibers/bristles more resilient fibers.

The leading roller 124 may have an outside diameter Dlr that is smaller than the outside diameter Dbr of the brush roll 122. For example, the diameter Dlr may be greater than zero and less than or equal to 0.8Dbr, greater than zero and less than or equal to 0.7Dbr, or greater than zero and less than or equal to 0.6Dbr. According to example embodiments, the diameter Dlr may be in the range of 0.3Dbr to 0.8Dbr, in the range of 0.4Dbr to 0.8Dbr, in the range of 0.3Dbr to 0.7Dbr, or in the range of 0.4Dbr to 0.7Dbr. As an illustrative example, the brush roll 122 may have an outside diameter of 48 mm and the leading roller 124 may have an outside diameter of 30 mm. While the leading roller 124 may have an outside diameter Dlr that is smaller than the outside diameter Dbr of the brush roll 122, the brush roll 122 may have bristles that are longer than the bristle and/or pile of the leading roller 124.

Positioning a leading roller 124 (having a diameter Dlr that is smaller than the diameter Dbr of the brush roll 122) in front of the brush roll 122 provides numerous benefits. For example, this arrangement decreases the height of the front side 112 of the surface cleaning head 100 (e.g., the housing 110) from the surface 10 to be cleaned. The decreased height of the front of the surface cleaning head 100 provides a lower profile that allows the surface cleaning head 100 to fit under objects (e.g., furniture and/or cabinets). Moreover, the lower height allows for the addition of one or more light sources 111 (e.g., but not limited to, LEDs), while still allowing the surface cleaning head 100 to fit under objects.

Additionally, the smaller diameter Dlr of the leading roller 124 allows the rotating axis of the leading roller 124 to be placed closer to the front side 112 of the surface cleaning head 100. When rotating, the leading roller 124 forms a generally cylindrical projection having a radius that is based on the overall diameter of the leading roller 124. As the diameter of the leading roller 124 decreases, the bottom contact surface 140 (FIG. 2) of the leading roller 124 moves forward towards the front side 112 of the surface cleaning head 100. In addition, when the surface cleaning head 100 contacts a vertical surface 12 (e.g., but not limited to, a wall, trim, and/or cabinet), the bottom contact surface 140 of the leading roller 124 is also closer to the vertical surface 12, thereby enhancing the front edge cleaning of the surface cleaning head 100 compared to a larger diameter leading roller. Moreover, the smaller diameter Dlr of the leading roller 124 also reduces the load/drag on the motor driving the leading roller 124, thereby enhancing the lifespan of the motor and/or allowing a smaller motor to be used to rotate both the brush roll 122 and leading roller 124.

The rotating brush roll 122 may be coupled to an electrical motor (either AC or DC) to cause the rotating brush roll 122 to rotate about the first rotating axis. The rotating brush roll 122 may be coupled to the electrical motor by way of a gears and/or drive belts. The leading roller 124 may be driven from the same drive mechanism used to drive the rotating brush roll 122 or a separate drive mechanism. An example of the drive mechanism is described in U.S. patent application Ser. No. 15/331,045, filed Oct. 21, 2016, which is incorporated herein by reference. Other drive mechanisms are possible and within the scope of the present disclosure.

In at least one embodiment, the brush roll 122 and the leading roller 124 rotate in the same direction directing debris toward the suction conduit 128, for example, counter clockwise as shown in FIG. 2. This arrangement may reduce the number of parts (e.g., no clutch or additional gear train may be necessary), thereby making the surface cleaning head 100 lighter, reducing drivetrain loss (thereby allowing for smaller/less expensive motors), and less expensive to manufacture. Optionally, the brush roll 122 and the leading roller 124 may rotate at same speed, thereby reducing the number of parts (e.g., no additional gear train necessary) and reducing drivetrain loss (thus, smaller/less expensive motor) and making the surface cleaning head 100 lighter and less expensive to manufacture.

As shown in FIG. 2, the leading roller 124 may be positioned within the housing 110 such that the bottom contact surface 140 is disposed closer to the surface 10 to be cleaned compared to the bottom contact surface of the brush roll 122. This arrangement allows the leading roller 124 to contact a surface 10 (e.g., a hard surface) without the brush roll 122 contacting the hard surface 10. As may be appreciated, the leading roller 124 is intended to pick up debris from a hard surface 10 while the brush roll 122 is intended to primarily contact a carpet surface. This arrangement is therefore beneficial since it allows the leading roller 124 to form a seal between the front 112 of the surface cleaning head 100 with the hard surface 10, thereby enhancing airflow and suction with the hard surface 10. Additionally, this arrangement reduces the drag/torque on the drive motor(s) since the brush roll 122 (in some embodiments) does not have to contact the hard surface 10. The reduced drag/torque may allow for a smaller, less expensive motor and/or may increase the lifespan of the motor.

One or both of the leading roller 124 and the brush roll 122 may be removable. The leading roller 124 may be removably coupled to the housing 110 of the surface cleaning head 100. For example, a portion of the housing 110 (such as, but not limited to, a portion of the left and/or right side 116*a*, 116*b*) may be removably/hingedly coupled thereto. To remove the leading roller 124, the removable portion may be unsecured/uncoupled from the rest of the housing 110, thereby allowing the leading roller 124 to disengage from a drive wheel and allowing the leading roller 124 to be removed from the leading roller chamber 126. Other ways of removably coupling the leading roller 124 within the housing 110 are also possible and within the scope of the present disclosure.

Figure 3:
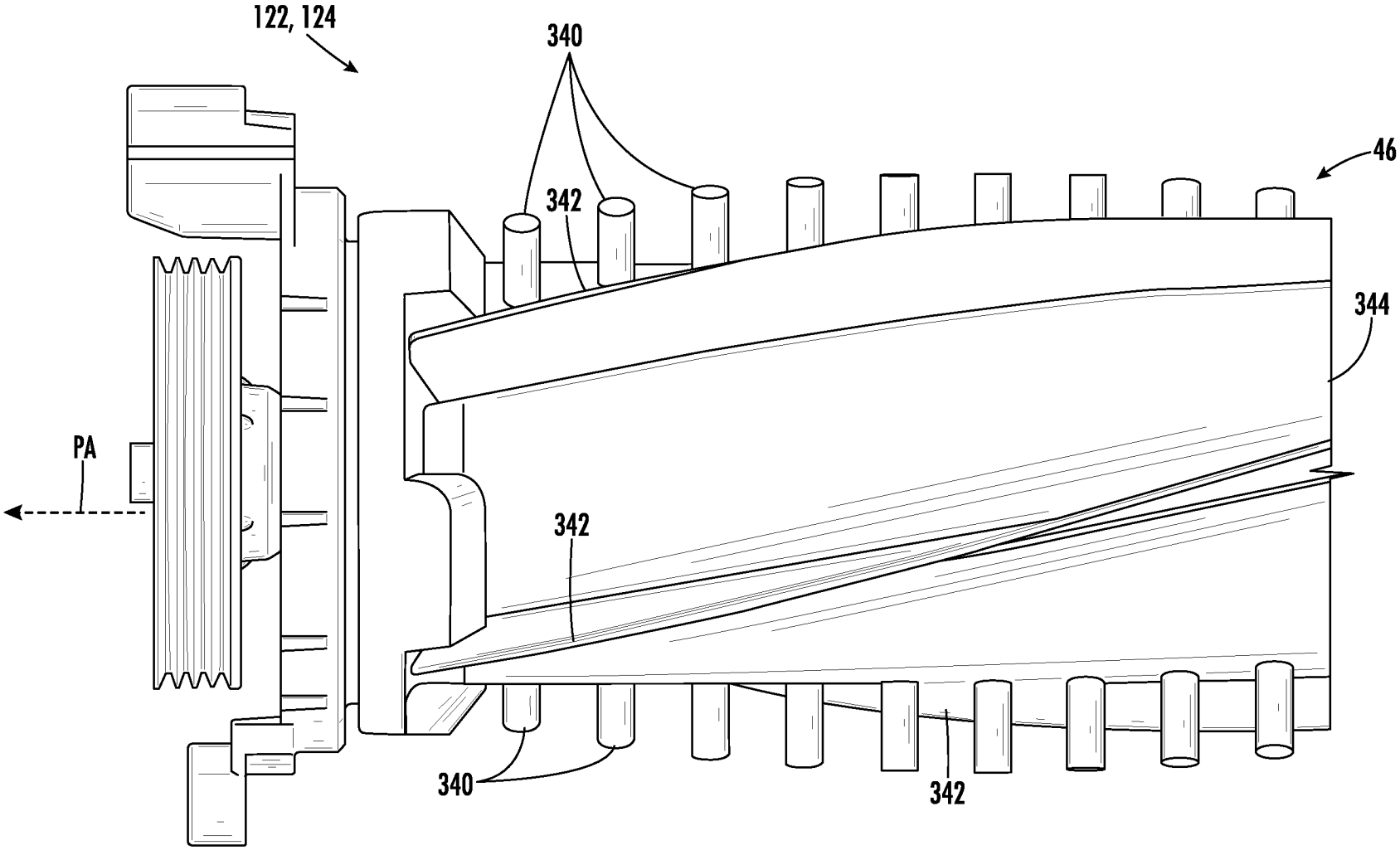
FIG. 3 is a side view of a portion of an agitator consistent with one or more aspects of the present disclosure including bristles and flexible sidewalls.

With reference to FIG. 3, the one or more of the agitators 122, 124 may include an elongated agitator body 344 that is configured to extend along and rotate about a longitudinal/pivot axis PA. The agitator 122, 124 (e.g., but not limited to, one or more of the ends of the agitator 122, 124) is permanently or removably coupled to the housing 110 and may be rotated about the pivot axis PA by a rotation system. The agitator 122, 124 may come into contact with elongated debris such as, but not limited to, hair, string, fibers, and the like (hereinafter collectively referred to as hair for ease of explanation). The hair may have a length that is much longer than the circumference of the agitator 122, 124. By way of a non-limiting example, the hair may have a length that is 2-10 times longer than the circumference of the agitator 122, 124. Because of the rotation of the agitator 122, 124 as well as the length and flexibility of the hair, the hair will tend to wrap around the circumference of the agitator 122, 124.

As may be appreciated, an excessive amount of hair building up on the agitator 122, 124 may reduce the efficiency of the agitator 122, 124 and/or causing damage to the cleaning apparatus 100 (e.g., the rotation systems or the like). To address the problem of hair wrapping around the agitator 122, 124, the agitator 122, 124 may optionally include a plurality of bristles 340 aligned in one or more rows or strips as well as one or more sidewalls and/or continuous sidewalls 342 adjacent to at least one row of bristles 340. The rows of bristles 340 and continuous sidewall 342 are configured to reduce hair from becoming entangled in the bristles 340 of the agitator 122, 124. Optionally, the combination of the bristles 340 and sidewall 342 may be configured to generate an Archimedes screw force that urges/causes the hair to migrate towards one or more collection areas and/or ends of the agitator 122, 124. The bristles 340 may include a plurality of tufts of bristles 340 arranged in rows and/or one or more rows of continuous bristles 340.

The plurality of bristles 340 extend outward (e.g., generally radial outward) from the elongated agitator body 344 (e.g., a base portion) to define one or more continuous rows. One or more of the continuous rows of bristles 340 may be coupled (either permanently or removably coupled) to the elongated agitator body 344 (e.g., to a base region of the body 344) using one or more form locking connections (such as, but not limited to, a tongue and groove connection, a T-groove connection, or the like), interference connections (e.g., interference fit, press fit, friction fit, Morse taper, or the like), adhesives, fasteners overmoldings, or the like.

The rows of bristles 340 at least partially revolve around and extend along at least a portion of the longitudinal axis/pivot axis PA of the elongated agitator body 344 of the agitator 122, 124. As defined herein, a continuous row of bristles 340 is defined as a plurality of bristles 340 in which the spacing between adjacent bristles 340 along the axis of rotation PA is less than or equal to 3 times the largest cross-sectional dimension (e.g., diameter) of the bristles 340.

As mentioned above, the plurality of bristles 340 are aligned in and/or define at least one row that at least partially revolves around and extends along at least a portion of the longitudinal axis/pivot axis PA of the elongated agitator body 344 of the agitator 122, 124. For example, at least one of the rows of bristles 340 may be arranged in a generally helical, arcuate, and/or chevron configuration/pattern/shape. Optionally, one or more of the rows of bristles 340 (e.g., the entire row or a portion thereof) may have a constant pitch (e.g., constant helical pitch). Alternatively (or in addition), one or more of the rows of bristles 340 (e.g., the entire row or a portion thereof) may have a variable pitch (e.g., variable helical pitch). For example, at least a portion of the row of bristles 340 may have a variable pitch that is configured to accelerate the migration of hair and/or generally direct debris towards the debris collection chamber.

At least one row of bristles 340 is proximate to (e.g., immediately adjacent to) at least one sidewall 342. The sidewall 342 may be disposed as close as possible to the nearest row of bristles 340, while still allowing the bristles 340 to bend freely left-to-right. For example, one or more of the sidewalls 342 may extend substantially continuously along the row of bristles 340. In one embodiment, at least one sidewall 342 extends substantially parallel to at least one of the rows of bristles 340. As used herein, the term "substantially parallel" is intended to mean that the separation distance between the sidewall 342 and the row of bristles 340 remains within 15% of the greatest separation distance along the entire longitudinal length of the row of bristles 340. Also, as used herein, the term "immediately adjacent to" is intended to mean that no other structure feature or element having a height greater than the height of the sidewall 342 is disposed between the sidewall 342 and a closest row of bristles 340, and that the separation distance D between the sidewall 342 and the closest row of bristles 340 is less than, or equal to, 5 mm (for example, less than or equal to 3 mm, less than or equal to 2.5 mm, less than or equal to 1.5 mm, and/or any range between 1.5 mm to 3 mm).

One or more of the sidewalls 342 may therefore at least partially revolve around and extend along at least a portion of the longitudinal axis/pivot axis PA of the elongated agitator body 344 of the agitator 122, 124. For example, at least one of the sidewalls 342 may be arranged in a generally helical, arcuate, and/or chevron configuration/pattern/shape. Optionally, one or more of the sidewalls 342 (e.g., the entire row or a portion thereof) may have a constant pitch (e.g., constant helical pitch). Alternatively (or in addition), one or more of the sidewalls 342 (e.g., the entire row or a portion thereof) may have a variable pitch (e.g., variable helical pitch).

While the agitator 122, 124 is shown having a row of bristles 340 with a sidewall 342 arranged behind the row of bristles 340 as the agitator 122, 124 rotates about the pivot axis PA, the agitator 122, 124 may include one or more sidewalls 342 both in front of and behind the row of bristles 340. As noted above, one or more of the sidewalls 342 may extend outward from a portion of the elongated agitator body 344 as generally illustrated. For example, one or more of the sidewalls 342 may extend outward from the base of the elongated agitator body 344 from which the row of bristles 340 is coupled and/or may extend outward from a portion of an outer periphery of the elongated agitator body 344. Alternatively (or in addition), one or more of the sidewalls 342 may extend inward from a portion of the elongated agitator body 344. For example, the radially distal-most portion of the sidewall 342 may be disposed at a radial distance from the pivot axis PA of the elongated agitator body 344 that is within 20 percent of the radial distance of the adjacent, surrounding periphery of the elongated agitator body 344, and the proximal-most portion of the sidewall 342 (i.e., the portion of the sidewall 342 which begins to extend away from the base) may be disposed at a radial distance that is less than the radial distance of the adjacent, surrounding periphery of the elongated agitator body 344. As used herein, the term "adjacent, surrounding periphery" is intended to refer to a portion of the periphery of the elongated agitator body 344 that is within a range of 30 degrees about the pivot axis PA.

The agitator 122, 124 may therefore include at least one row of bristles 340 substantially parallel to at least one sidewall 342. According to one embodiment, at least a portion (e.g., all) of the bristles 340 in a row may have an overall height Hb (e.g., a height measured from the pivot axis PA) that is longer than the overall height Hs (e.g., a height measured from the pivot axis PA) of at least one of the adjacent sidewalls 342. Alternatively (or in addition), at least a portion (e.g., all) of the bristles 340 in a row may have a height Hb that is 2-3 mm (e.g., but not limited to, 2.5 mm) longer than the height Hs of at least one of the adjacent sidewalls 342. Alternatively (or in addition), the height Hs of at least one of the adjacent sidewalls 342 may be 60 to 100% of the height Hb of at least a portion (e.g., all) of the bristles 340 in the row. For example, the bristles 340 may have a height Hb in the range of 12 to 32 mm (e.g., but no limited to, within the range of 122, 124 to 20.5 mm) and the adjacent sidewall 342 may have a height Hs in the range of 10 to 29 mm (e.g., but no limited to, within the range of 15 to 122, 124 mm).

The bristles 340 may have a height Hb that extends at least 2 mm. beyond the distal-most end of the sidewall 342. The sidewall 342 may have a height Hs of at least 2 mm from the base, and may up a height Hs that is 50% or less of the height Hb of the bristles 340. At least one sidewall 342 should be disposed close enough to the at least one row 46 of bristles 340 to increase the stiffness of the bristles 340 in at least one front-to-back direction as the agitator 122, 124 is rotated during normal use. The sidewall 342 may therefore allow the bristles 340 to flex much more freely in at least one side-to-side direction compared to a front-to-back direction. For example, the bristles 340 may be 25%-40% (including all values and ranges therein) stiffer in the front-to-back direction compared to side-to-side direction. According to one embodiment, the sidewall 342 may be located adjacent to (e.g., immediately adjacent to) the row 46 of bristles 340. For example, the distal most end of the sidewall 342 (i.e., the end of the sidewall 342 furthest from the center of rotation PA) may be 0-10 mm from the row 46 of bristles 340, such as 1-9 mm from the row 46 of bristles 340, 2-7 mm from the row 46 of bristles 340, and/or 1-5 mm from the row 46 of bristles 340, including all ranges and values therein.

According to one embodiment, the sidewall 342 includes flexible and/or elastomeric. Examples of a flexible and/or elastomeric material include, but are not limited to, rubber, silicone, and/or the like. The sidewall 342 may include a combination of a flexible material and fabric. The combination of a flexible material and fabric may reduce wear of the sidewall 342, thereby increasing the lifespan of the sidewall 342. The rubber may include natural and/or synthetic, and may be either a thermoplastic and/or thermosetting plastic. The rubber and/or silicone may be combined with polyester fabric. In one embodiment, sidewall 342 may include cast rubber and fabric (e.g., polyester fabric). The cast rubber may include natural rubber cast with a polyester fabric. Alternatively (or in addition), the cast rubber may include a polyurethane (such as, but not limited to, PU 45 Shore A) and cast with a polyester fabric.

The agitator 122, 124 (e.g., the bristles 340) should be aligned within the agitator chamber 20 such that the bristles 340 are able to contact the surface to be cleaned. The bristles 340 should be stiff enough in the direction of rotation to engage the surface to be cleaned (e.g., but not limited to, carpet fibers) without undesirable bending (e.g., stiff enough to agitate debris from the carpet), yet flexible enough to allow side-to-side bending. Both the size (e.g., height Hs) and location of the sidewalls 342 relative to the row of bristles 340 may be configured to generally prevent and/or reduce hair from becoming entangled around the base or bottom of the bristles 340. The bristles 340 may be sized so that when used on a hard floor, it is clear of the floor in use. However, when the surface cleaning apparatus 10 is on carpet, the wheels 16 will sink in and the bristles 340 will penetrate the carpet. The length of bristles 340 may be chosen so that it is always in contact with the floor, regardless of floor surface. Additional details of the agitator 122, 124 (such as, but not limited to, the bristles 340 and sidewall 342) are described in copending U.S. Patent Application Ser. No. 62/385,572 filed Sep. 9, 2016, which is fully incorporated herein by reference.

Figure 4:
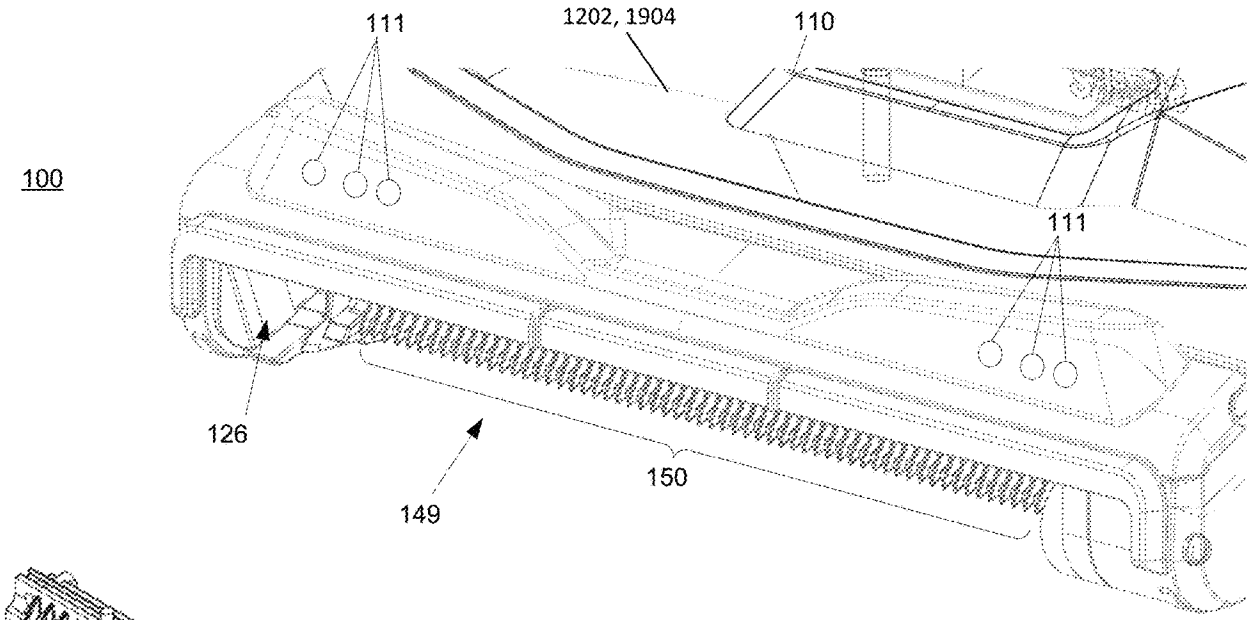
FIG. 4 is a front perspective view of the front region of the surface cleaning head of FIG. 1 without the leading roller and illustrating the combing unit.
Figure 5:
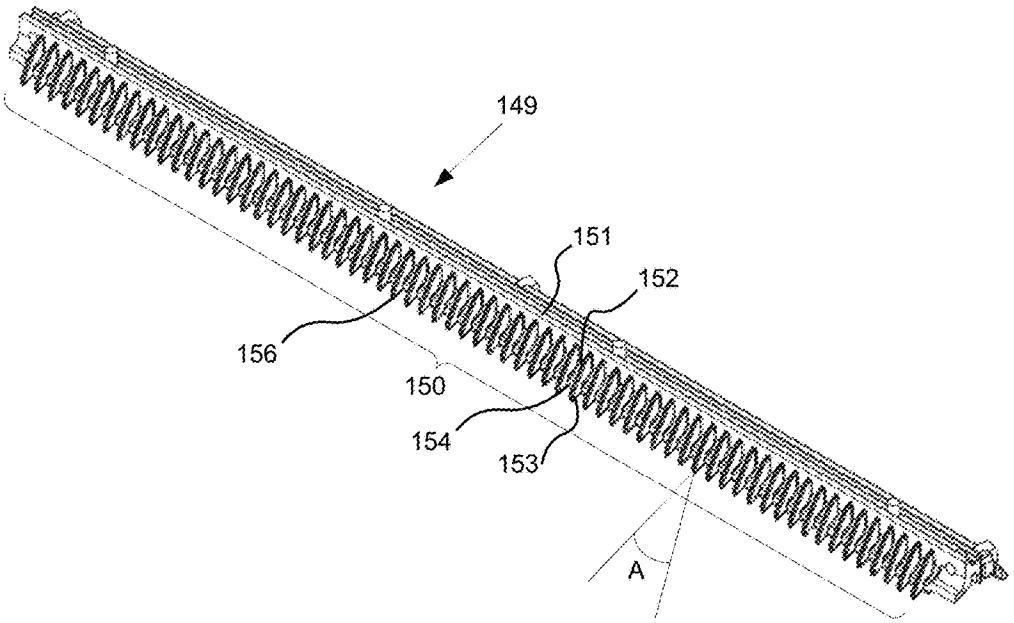
FIG. 5 is an enlarged perspective view of one embodiment of a combing unit.

The surface cleaning head 100 may also include one or more combing units/debriders each having a series of combing protrusions (also referred to as debriding protrusions) configured to contact one or more of the agitators (e.g., brush roll 122 and/or the leading roller 124). One example of the combing unit/debrider 149 as shown in greater detail in FIGS. 4-5. The combing protrusions 150 may be configured to remove debris (such as, but not limited to, hair, string, and the like) that may be wrapped around and/or entrapped/entrained in/on the brush roll 122 and/or the leading roller 124 as the surface cleaning head 100 is being used (e.g., without the user having to manually remove the debris from the brush roll 122 and/or the leading roller 124). According to one embodiment, the combing protrusions 150 may contact only the brush roll 122 or only the leading roller 124.

The combing protrusions 150 may include a plurality of spaced teeth/ribs 152 with angled edges 153 (see, e.g., FIG. 6) extending into contact with a surface of the brush roll 122 and/or the leading roller 124. The spaced ribs 152 extend from a back support 151 with base portions 154 located therebetween to reinforce the spaced ribs 152. Although the illustrated embodiment shows the combing unit 149 with teeth 152 extending from a single back support 151, the combing unit 149 may also include multiple back supports 151, each with one or more include teeth 152. The angled edges 153 of the spaced ribs 152 may be arranged at an angle A (see FIGS. 5 and 7) that is in the range of 15-20 degrees, for example, 20-25 degrees, such as 23.5 degrees. This example structure of the combing protrusions 150 may allow for increased strength and reduced frictional loses since less points may contact the brush roll 122 and/or the leading roller 124. Other shapes and configurations for the combing protrusions 150 are also within the scope of the present disclosure.

The combing teeth 152 have angled leading edges 153 that are not aligned with a rotation center of the agitator(s) 122, 124. The angled leading edges 153 are the edges that an incoming portion of the rotating agitator(s) 122, 124 hits first and are directed toward or into a direction of rotation of the agitator(s) 122, 124. More specifically, the leading edge 153 of a combing tooth 152 forms an acute angle $\alpha$ relative to a line extending from an intersection point where the leading edge 153 intersects with an outer surface of the agitator(s) 122, 124 to the rotation center. In some embodiments, the angle is in a range of 5° to 50° and more specifically in a range of 20° to 30° and even more specifically about 24° to 25°.

In some embodiments, the combing teeth 152 are positioned as close as possible to the bottom contact point of the agitator(s) 122, 124 but high enough to prevent being caught on a surface being cleaned (e.g., a carpet). The combing teeth 152, for example, may be positioned just above the lowest structure on the housing 110 of the cleaning apparatus 100. Positioning the combing teeth 152 closer to the bottom contact point of the agitator(s) 122, 124 allows debris to be intercepted and removed as soon as possible, thereby improving debris removal.

Again, it should be appreciated that the combing unit 149 may have other orientations and positions relative to the agitator(s) 122, 124 (e.g., above the rotation center). In a robotic vacuum cleaner, for example, the combing unit 149 may be positioned higher to prevent the combing teeth 152 from interfering with the debris being deposited into a dust bin.

The combing teeth 152 may extend into the agitator(s) 122, 124 to a depth in a range of 0% to 50% of the cleaning roller radius for a soft roller and 0% to 30% of the cleaning roller radius for a tufted brush roll. In one embodiment, the cleaning roller 124 is a soft roller (e.g., nylon bristles with a diameter less than or equal to 0.15 mm and a length greater than 3 mm) and the combing teeth 152 extend into the soft cleaning roller 124 in a range of 15% to 35%. For example, one or more of the combing teeth 152 may be configured to contact the bristles 340 (FIG. 3) or flexible strips/sidewalls 342.

In the illustrated embodiments, the combing teeth 152 have a triangular-shaped "tooth" profile with a wider base or root 154 (see, e.g., FIG. 6) having a root width $W_r$ and a tip 156 having a diameter $D_r$. In general, the base or root 154 may be wide enough to prevent the tooth 152 from bending upward when contacted by the rotating cleaning roller 124 and the tip 156 may be sharp enough to catch the debris. In some embodiments, the tip 156 may be rounded with a diameter in the range of less than 3 mm and more specifically in the range of 1 to 2 mm and even more specifically about 1.6 mm. The root width $W_r$ may be in a range of 5 to 6 mm.

In another embodiment, combing teeth 152 have a curved profile with curved leading edges 153 forming a concave curve. In this embodiment, a line extending from the curved leading edge 153 at the tip 156 forms an angle $\alpha$ with the line extending from the intersection point to the rotation center RA1/RA2. The combing teeth 152 with curved edges may be positioned and spaced similar to the teeth 152 with straight leading edges 153 as described and shown herein.

The combing unit 149 may include combing teeth 152 spaced 4 to 16 teeth per inch and more specifically 7 to 9 teeth per inch. The combing teeth 152 may be made of plastic or metal and may have a thickness that provides a desired rigidity to prevent bending when engaged with the agitator(s) 122, 124. In some embodiments, the combing teeth 152 may have a thickness in a range of 0.5 to 2 mm depending upon the material. In one example, the combing teeth 152 are made of plastic and have a thickness of 0.8 mm, a spacing S of about 2.4 mm, and a center-to-center spacing $S_c$ of about 3.3 mm.

Although the combing unit 149 is shown with combing teeth 152 having an equal spacing, a combing unit 149 may also include teeth 152 with different spacings including, for example, groups of equally spaced teeth. The combing unit 149 may include a section at the center of the agitator(s) 122, 124 with no teeth and groups of combing teeth 152 proximate ends of the agitator(s) 122, 124 where the hair and similar debris migrates during rotation. Although the combing unit 149 is shown with teeth 152 having the same shape or tooth profile and dimensions, the combing unit 149 may include teeth of different shapes, profiles dimensions and configurations at different locations along the combing unit 149.

The combing unit 149 may extend along a substantial portion of a length of the agitator(s) 122, 124 (i.e., more than half) such that the combing teeth 152 remove debris from a substantial portion of the cleaning surface of the agitator(s) 122, 124. In an embodiment, the combing teeth 152 may engage the cleaning surface of the agitator(s) 122, 124 along, for example, greater than 90% of a length of one or more of the cleaning surface(s) of the agitator(s) 122, 124. The combing unit 149 works particularly well with agitator(s) 122, 124 that are designed to move hair and other similar debris away from a center of the agitator(s) 122, 124.

Figure 8:
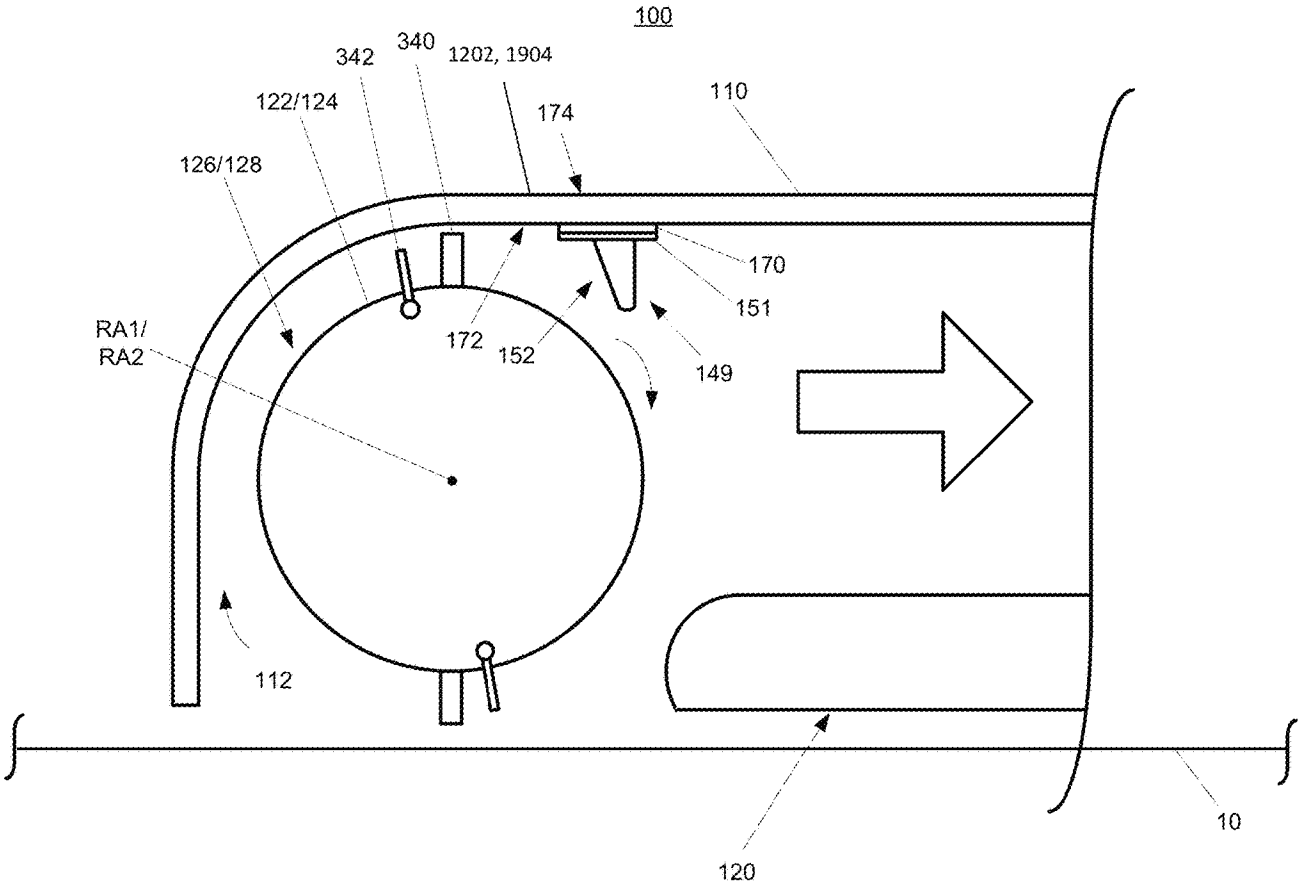
FIG. 8 is a cross-sectional view of one embodiment showing the combing unit coupled to the housing of a surface cleaning head with an isolator.

Turning to FIG. 8, the combing unit 149 may be mounted to any portion of the surface cleaning head 100. For example, the combing unit 149 may be mounted within a chamber 126, 128 containing either the brush roll 122 and/or the leading roller 124. The combing unit 149 may be mounted, coupled, and/or otherwise secured to a portion of the surface cleaning head 100 (e.g., a portion of the housing 110) using one or more isolators 170. The isolators 170 may comprise an elastomeric material configured to absorb at least some of the energy (e.g., acoustic and/or vibrational energy) transmitted by the rotating roller as it rotates past and contacts the plurality of teeth of the debriding rib. The isolator 170 may convert the energy (e.g., acoustic and/or vibrational energy) from the combing unit 149 into heat, thereby reducing the transfer of acoustic and/or vibrational energy to the cleaning apparatus 100 (e.g., but not limited to, the nozzle housing 110). The isolators 170 therefore significantly reduce the noise and/or vibration due to the interaction of either the brush roll 122 and/or the leading roller 124 against the combing unit 149, which in turn improves the user experience.

In the illustrated embodiment, the isolator 170 is disposed between the back support 151 of the combing unit 149 and the housing 110 (e.g. nozzle). For example, the isolator 170 may be disposed between the back support 151 of the combing unit 149 and an interior surface 172 of the chamber 126, 128 containing either the brush roll 122 and/or the leading roller 124. It should be appreciated, however, that the isolator 170 may be located between the combing unit 149 and an exterior surface 174, and between the isolator 170 and any surface between the interior and exterior surfaces 172, 174. The isolator 170 may therefore be configured to contact at least a portion of the combing unit 149 and the housing 110.

Figure 9:
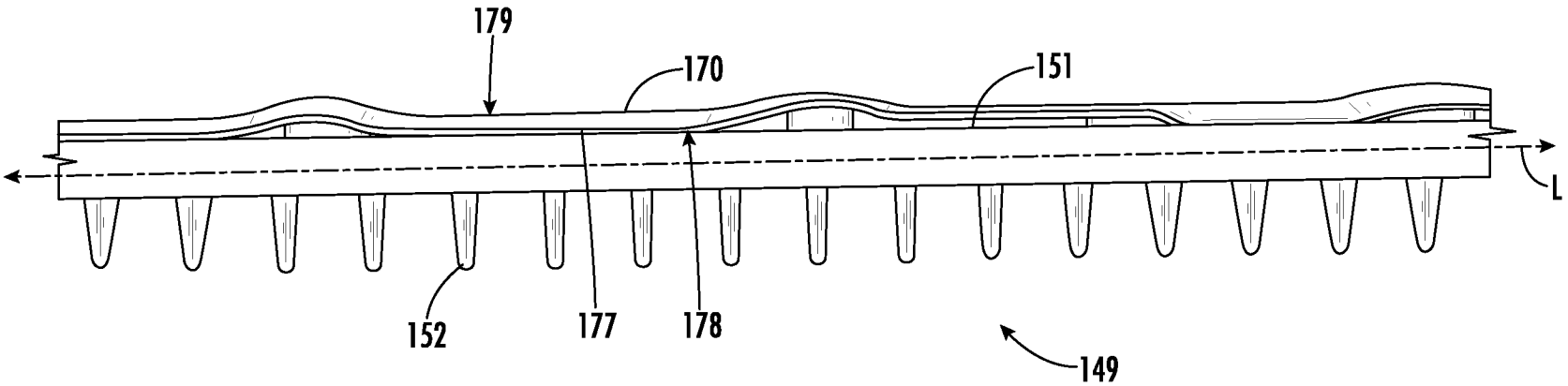
FIG. 9 is a front view one embodiment of a combing unit and an isolator.

Turning now to FIG. 9, a perspective view of one embodiment of the combing unit 149 and an isolator 170 is generally shown. In the illustrated embodiment, a single isolator 170 is shown extending substantially continuously with (e.g., coextensive with) the combing unit 149 (e.g., the back support 151), though it should be appreciated that one or more isolators 170 may be adjacent to each other along the longitudinal length L of the combining unit 149 (e.g., the back support 151). For example, two or more isolators 170 may be run parallel to each other along a common portion of the combing unit 149 in a side-by-side arrangement and/or two or more isolators 170 may run sequentially to each other when moving along the longitudinal axis L of the combing unit 149. Alternatively (or in additional), two or more isolators 170 may be stacked upon each other in a direction substantially transverse the longitudinal axis L. As used herein the phrase "substantially coextensive with" is intended to mean that the isolator 170 is in contact with at least 80% of the surface of the combining unit 149 (e.g., the back support 151) that is immediately adjacent to (e.g., between) the combining unit 149 and the mounting surface with the housing 110. For example, the isolator 170 may contact at least 90% of the surface of the combining unit 149 and/or contact at least 95% of the surface of the combining unit 149. It should also be appreciated that the isolator(s) 170 do not have to be coextensive with the combing unit 149 (e.g., the back support 151). In such an embodiment, the isolator(s) 170 may be disposed between the combing unit 149 and the housing 110 along only a portion of the combing unit 149.

According to one embodiment, the isolator 170 may include a rubber material. Alternatively (or in addition), the isolator 170 may include a foam material such as, but not limited to, a closed and/or open cell foam and/or sponge. By way of a non-limiting example, the material may include Ethylene Propylene Diene Monomer (EPDM) closed cell sponge rubber. The isolator 170 may have a thickness in the range of 1/16" to 1". The isolator 170 may optionally provide weather-proofing capabilities. According to one embodiment, one or more surfaces of the isolator 170 may include an adhesive layer 177. The adhesive layer 177 may disposed on an inner surface 178 of the isolator 170 to secure the isolator 170 to the combing unit 149, for example, to the backing support 151, to facilitate assembly of the combing unit 149 to the housing 110. Alternatively, the adhesive layer 177 may disposed on an outer surface 179 of the isolator 170 to secure the isolator 170 to the housing 110.

According to on embodiment, the isolator 170 may be configured to primarily reduce noise, not necessarily vibrations. In other words, the isolator 170 may be used to dampen sound caused by the agitator(s) 122, 124 contacting the combing unit 149 and being transmitted to the housing 110. Using the isolator 170 may reduce the noise factor by "deadening" the resonating qualities of the sound waves. For example, waves and valleys in the foam can trap the sound waves and interrupt them. Of course, the isolator 170 may also reduce vibration from being transmitted from the combing unit 149 to the housing 110.

FIGS. 10 and 11 illustrate examples of two different types of vacuum cleaners 1000, 1100 that may include a surface cleaning head 100 and a combing unit (not shown) consistent with the embodiments described herein. For example, the vacuum cleaner 1000 may include an upright vacuum cleaner with a removable canister 1001 coupled to a wand 1002, such as the type described in U.S. Patent Application Pub. No. 2015/0351596, which is commonly owned and fully incorporated herein by reference. The vacuum cleaner 1100 may include a stick type vacuum cleaner with a removable handheld vacuum 1101 coupled at one end of a wand 1102, such as the type described in U.S. Patent Application Pub. No. 2015/0135474, which is commonly owned and fully incorporated herein by reference.

FIG. 12 illustrates a robotic vacuum cleaner 1200 that includes a surface cleaning head 100 having a housing 110 and one or more agitators 122/124 with a combing unit (not shown) as disclosed herein. The robotic vacuum cleaner 1200 may also include one or more wheels 1203 for moving about a surface to be cleaned. An example of the combing unit used in a robotic vacuum cleaner is disclosed in greater detail in U.S. Provisional Application No. 62/469,853, filed Mar. 10, 2017, which is incorporated herein by reference.

While combing units are generally effective at preventing and/or reducing debris buildup on the agitator, the contact between the combing teeth and the agitator may cause noise and/or wear to the combing teeth or agitator as the agitator rotates. One or more aspects of the present disclosure may feature systems and methods for removing debris from a cleaning roller using a combing unit which can be selected between an active mode and an inactive mode. During an active mode, the combing unit may be mounted within the suction conduit (e.g., an agitation chamber) such that one or more of the combing teeth are configured to contact against at least a portion of one or more agitators (e.g., a brush roll, a leading roller, and/or the like) as the agitator rotates within the suction conduit. Contact between the combing teeth and the agitator (e.g., contact between the combing teeth and at least one of the bristles or flexible strips) may generally prevent and/or reduce debris (e.g., but not limited to, hair or the like) from becoming wrapped around the agitator. During the inactive mode, the agitator may rotate within the suction conduit without contacting a combining unit. According to one aspect, the combining unit may be user selectable between the active mode and inactive mode (i.e., the user may select between the active mode and the inactive mode). Alternative (or in addition), the combining unit may be automatically toggled between the active mode and inactive mode. For example, the combining unit may be automatically toggled between the active mode and inactive mode in response to one or more predefined events such as, but not limited to, upon powering up and/or powering down the agitator and/or surface cleaning head, after a predetermined amount of time, or the like.

Figure 13:
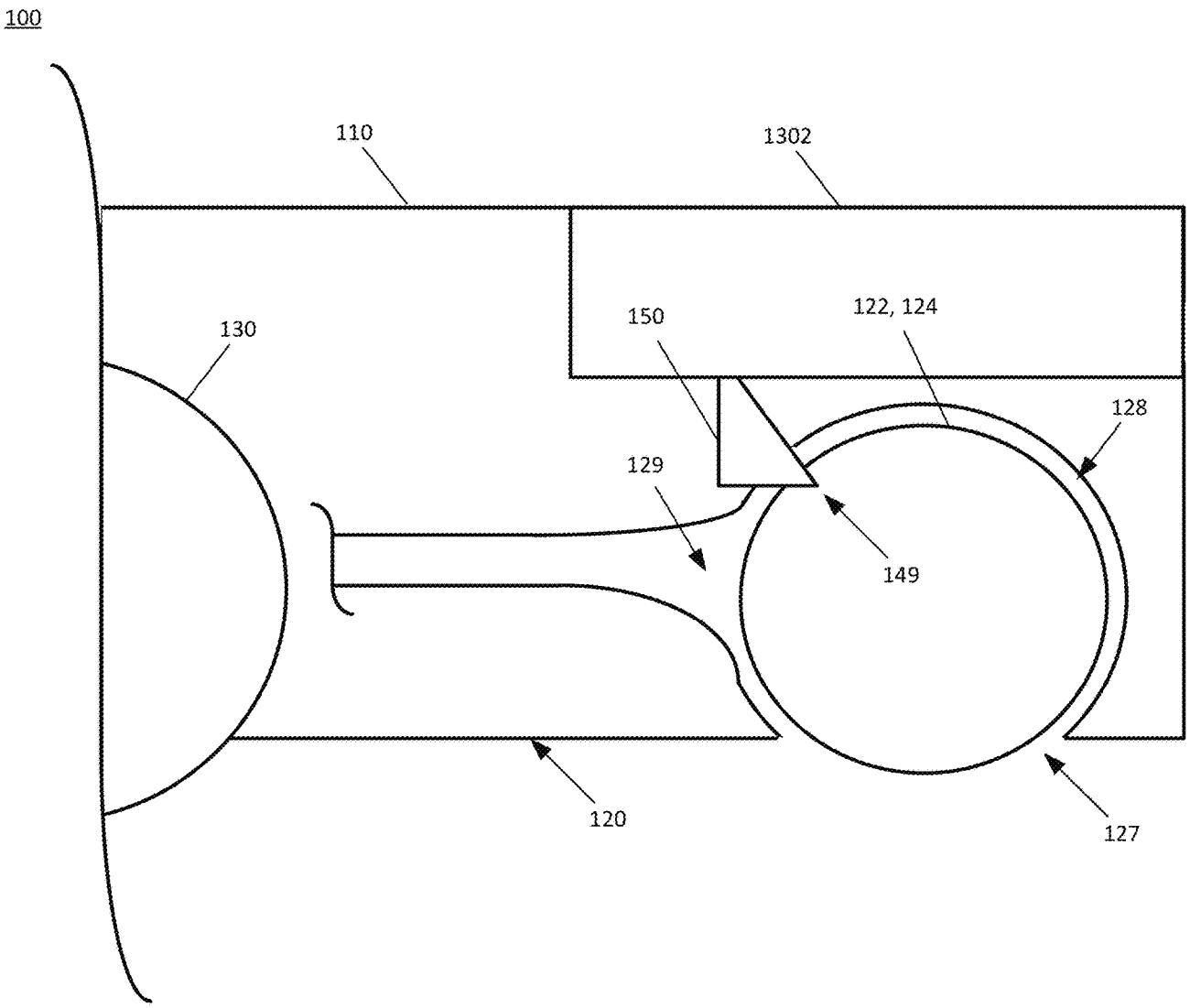
FIG. 13 is one example of a surface cleaning head including a combining unit configured to be toggled between an active mode and an inactive mode.

Turning now to FIG. 13, one example of a surface cleaning head 100 is generally illustrated in the active mode. It should be appreciated that the surface cleaning head 100 may form part of any cleaning apparatus including, without limitation, an "all in the head" type vacuum, upright vacuum cleaners, canister vacuum cleaners, stick vacuum cleaners, robotic vacuum cleaners and central vacuum systems, and may be used in sweepers (e.g., low or no suction). The surface cleaning head 100 includes a housing 110 including a suction conduit 128 having an opening 127 on the underside 120 of the housing 110. The suction conduit 128 is fluidly coupled to a dirty air inlet 129, which leads to a suction motor (not shown) either in the surface cleaning head 100 or another location in the vacuum. While the illustrated surface cleaning head 100 includes a single agitator 122, 124 at least partially disposed within the suction conduit 128, it should be appreciated that the surface cleaning head 100 may include multiple rotating agitators (for example, a brush roll 122 and a leading roller 124) disposed in one or more agitation chambers. The surface cleaning head 100 may also include one or more wheels 130 and/or additional features not shown, but described herein.

The surface cleaning head 100 may also include one or more combing units/debriders 149 each having a series of combing protrusions (also referred to as debriding protrusions) 150 configured to contact one or more of the agitators (e.g., brush roll 122 and/or the leading roller 124). One example of the combing unit 149 as shown in greater detail in FIGS. 4-5. The combing protrusions 150 may be configured to remove debris (such as, but not limited to, hair, string, and the like) that may be wrapped around and/or entrapped/entrained in/on the agitator 122, 124 as the surface cleaning head 100 is being used.

Figure 6:
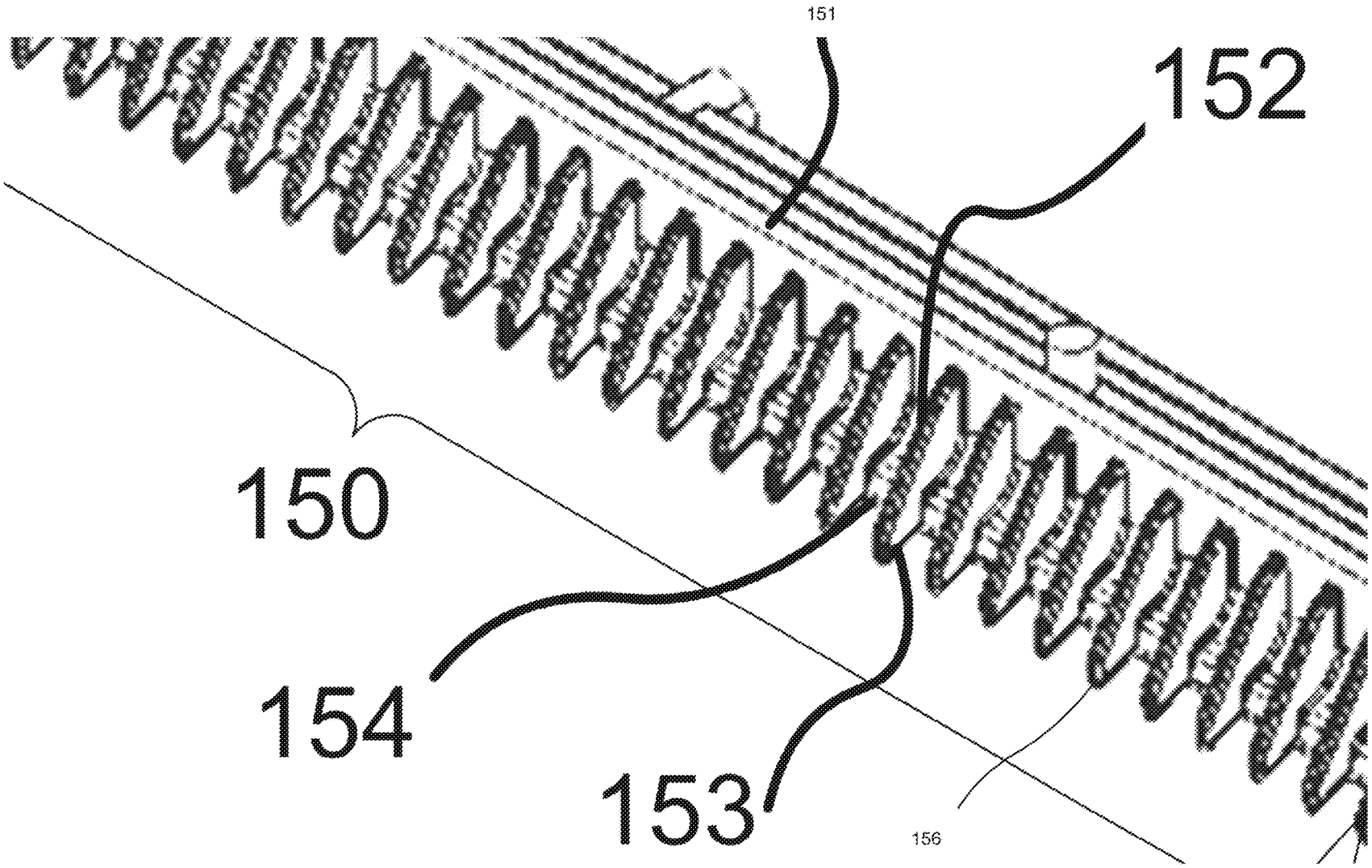
FIG. 6 is an enlarged view of a portion of the combing unit of FIG. 5.
Figure 7:
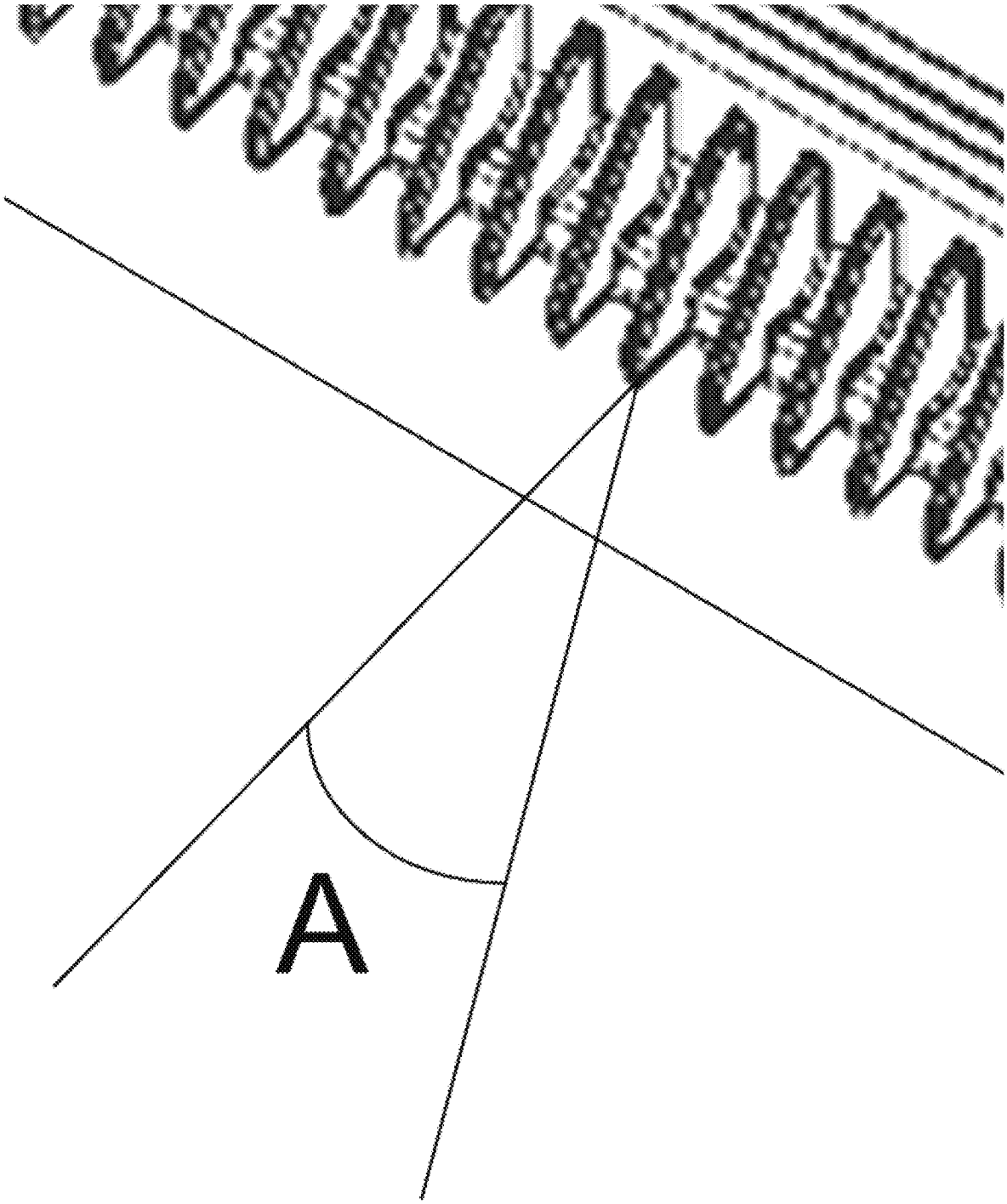
FIG. 7 is an enlarged view of another portion of the combing unit of FIG. 5.

The combing protrusions 150 may include a plurality of spaced teeth/ribs 152 with angled edges 153 (see, e.g., FIG. 6). When in the active mode, the combing unit 149 may be coupled to the housing 110 such that the combing protrusions 150 contact a surface of the agitator 122, 124 (such as, but not limited to, contact with the bristles 340 or flexible strips/sidewalls 342 as generally illustrated in FIG. 8). The combing unit 149 may be coupled to any portion of the housing 110. For example, the combing unit 149 may be coupled to a removable panel 1302 such that combing unit 149 contacts the agitator 122, 124 as the agitator 122, 124 rotates. In this configuration, the removable panel 1302 may be referred to an active mode panel 1302. The active mode panel 1302 may be secured to any side of the housing 110 such as, but not limited to, the upper side/surface 118. Optionally, at least a portion of the active mode panel 1302 may be formed from a transparent and/or semi-transparent material. In this manner, the user may see the combing unit 149 engaging with the agitator 122, 124 as the agitator 122, 124 rotates within the suction conduit 128 during normal use.

Figure 14:
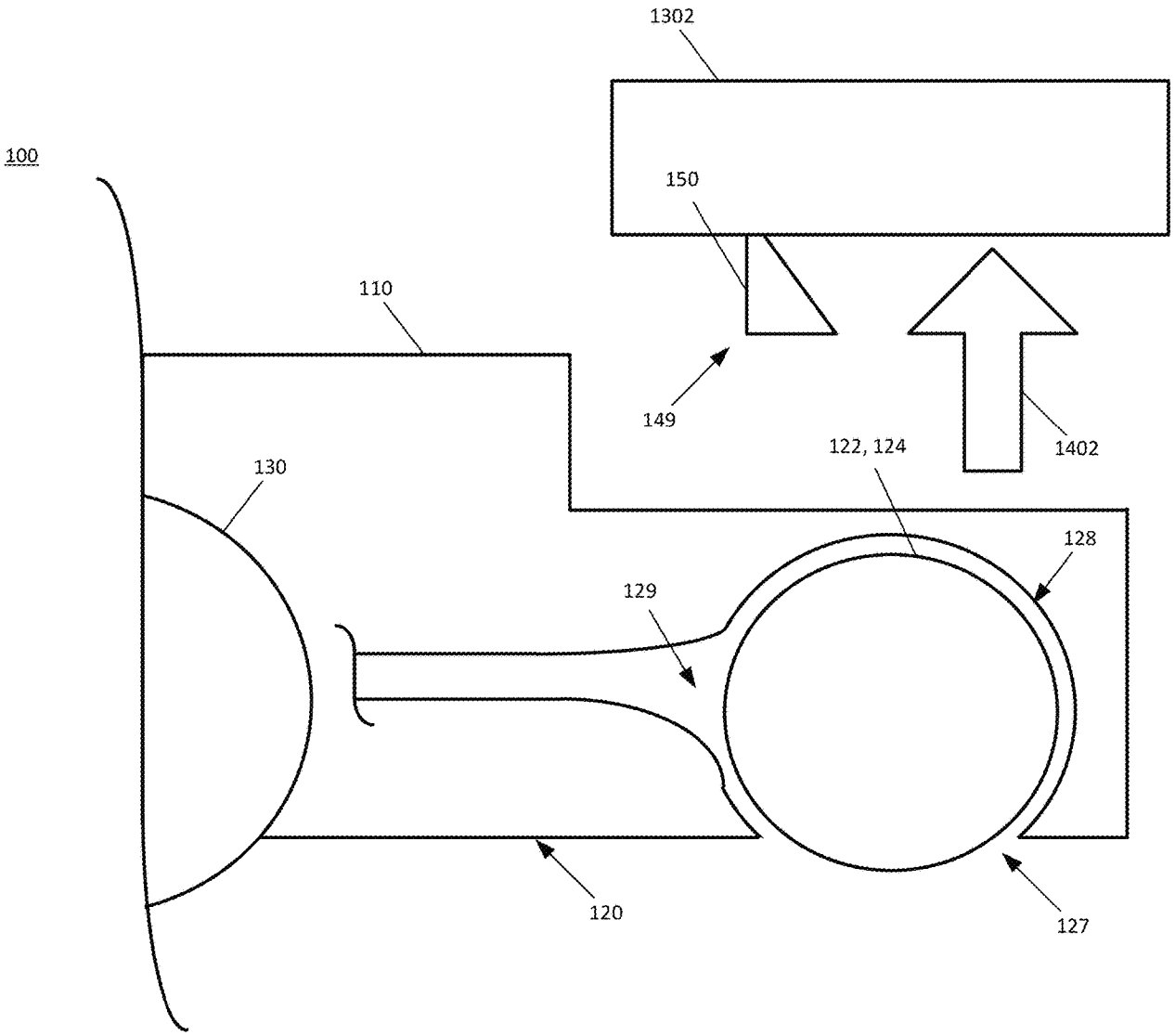
FIG. 14 is one example of a surface cleaning head with a removable panel.
Figure 15:
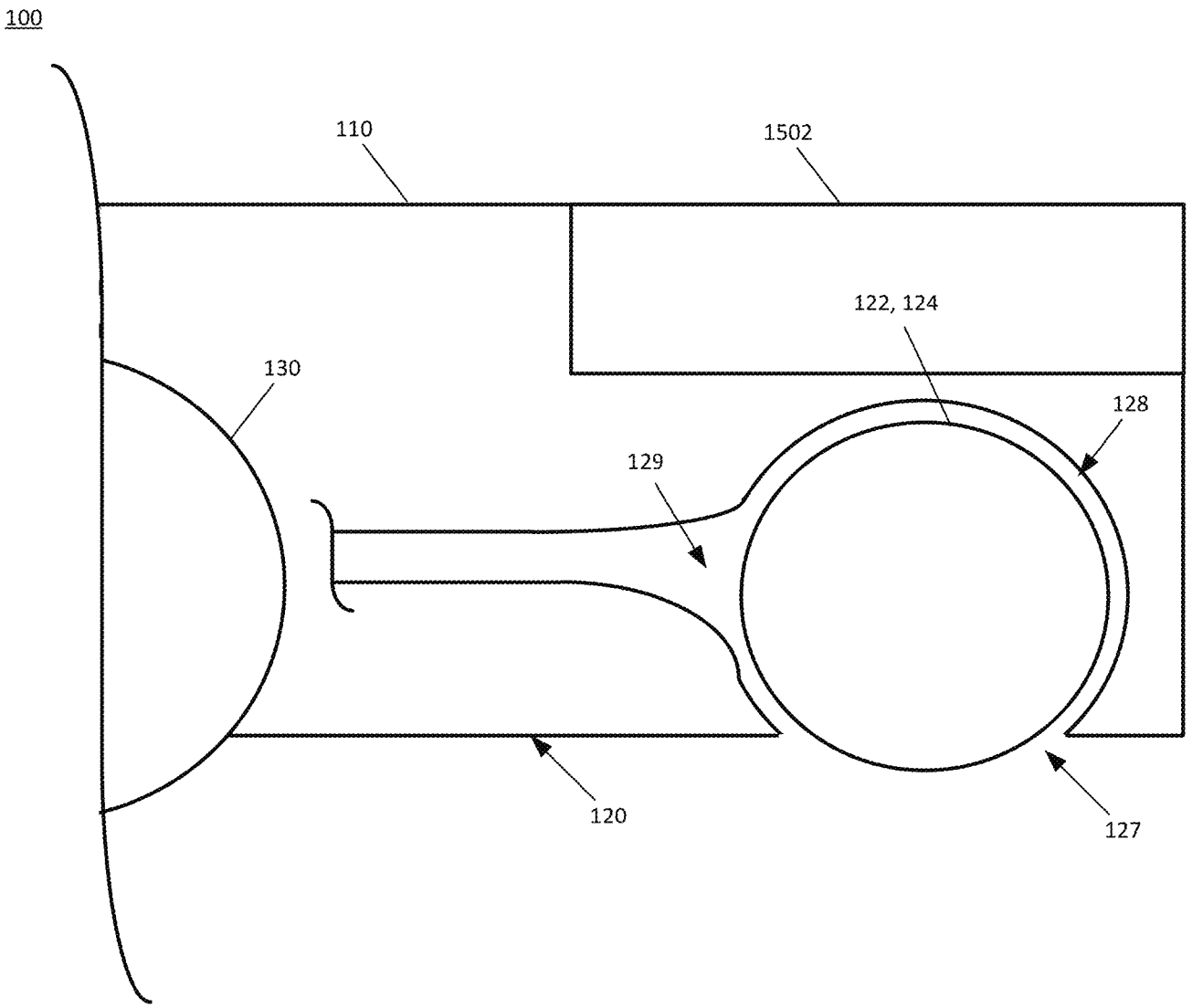
FIG. 15 is one example of a surface cleaning head with a removable panel without a combining unit in an inactive mode.
Figure 16:
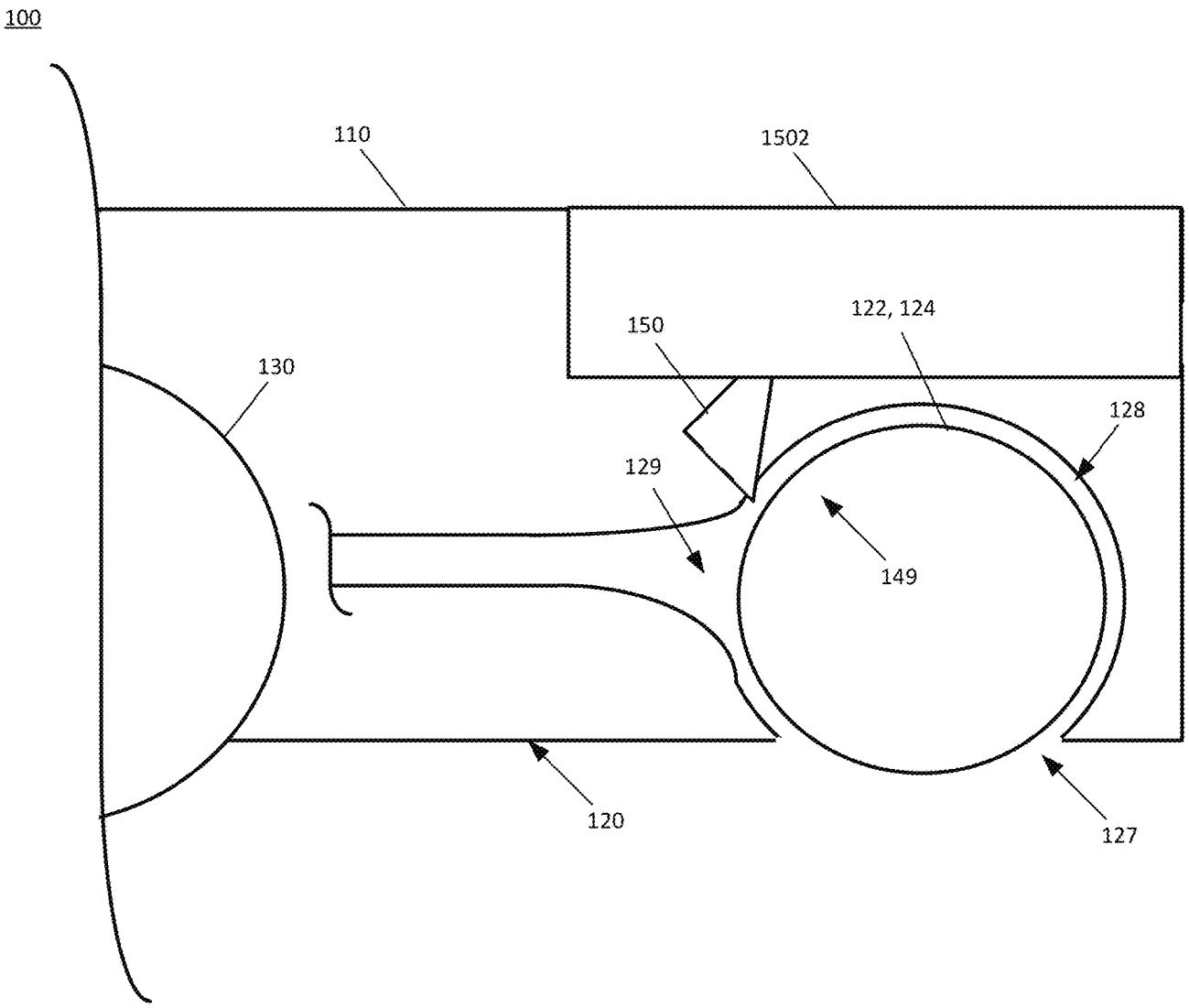
FIG. 16 is one example of a surface cleaning head with a removable panel having a combining unit in an inactive mode.

To select the inactive mode, the active mode panel 1302 (including the combing unit 149) may be removed from the housing 110 by a user as indicated by arrow 1402 in FIG. 14 and replaced with a removable inactive mode panel 1502 as generally illustrated in FIG. 15. The inactive mode panel 1502 may include a removable panel configured to be removably secured to the housing 110 which does not have a combing unit 149. Alternatively, the inactive mode panel 1502, FIG. 16, may include a removable panel configured to be removably secured to the housing 110 which includes a combing unit 149 configured to not contact the agitator 122, 124 as the agitator 122, 124 rotates. In one embodiment, the combing unit 149 of the active mode panel 1302 may be configured move from an active position (as generally illustrated in FIG. 13) to an inactive position in which the combing unit 149 is configured to not contact the agitator 122, 124 (as generally illustrated in FIG. 14). As such, the inactive mode panel 1502 may be the same as the active mode panel 1202 with the combing unit 149 in a different position. Alternatively, the inactive mode panel 1502 may be a separate and distinct panel from the active mode panel 1302. In such an embodiment, the active mode panel 1302 of FIG. 13 may be replaced with an entirely different panel (i.e., an inactive mode panel) in which the combing unit 149 is configured to not contact the agitator 122, 124. It should be appreciated that the active mode and inactive mode panels 1302, 1502 may be secured to the housing 110 in any manner known to those of ordinary skill in the art. For example, the panels 1302, 1502 may be secured to the housing 110 using a connection mechanism that does not require the use of any tools. Non-limiting of tool-less connection mechanisms includes depressible tabs, latches, detents, buttons, or the like.

Figure 17:
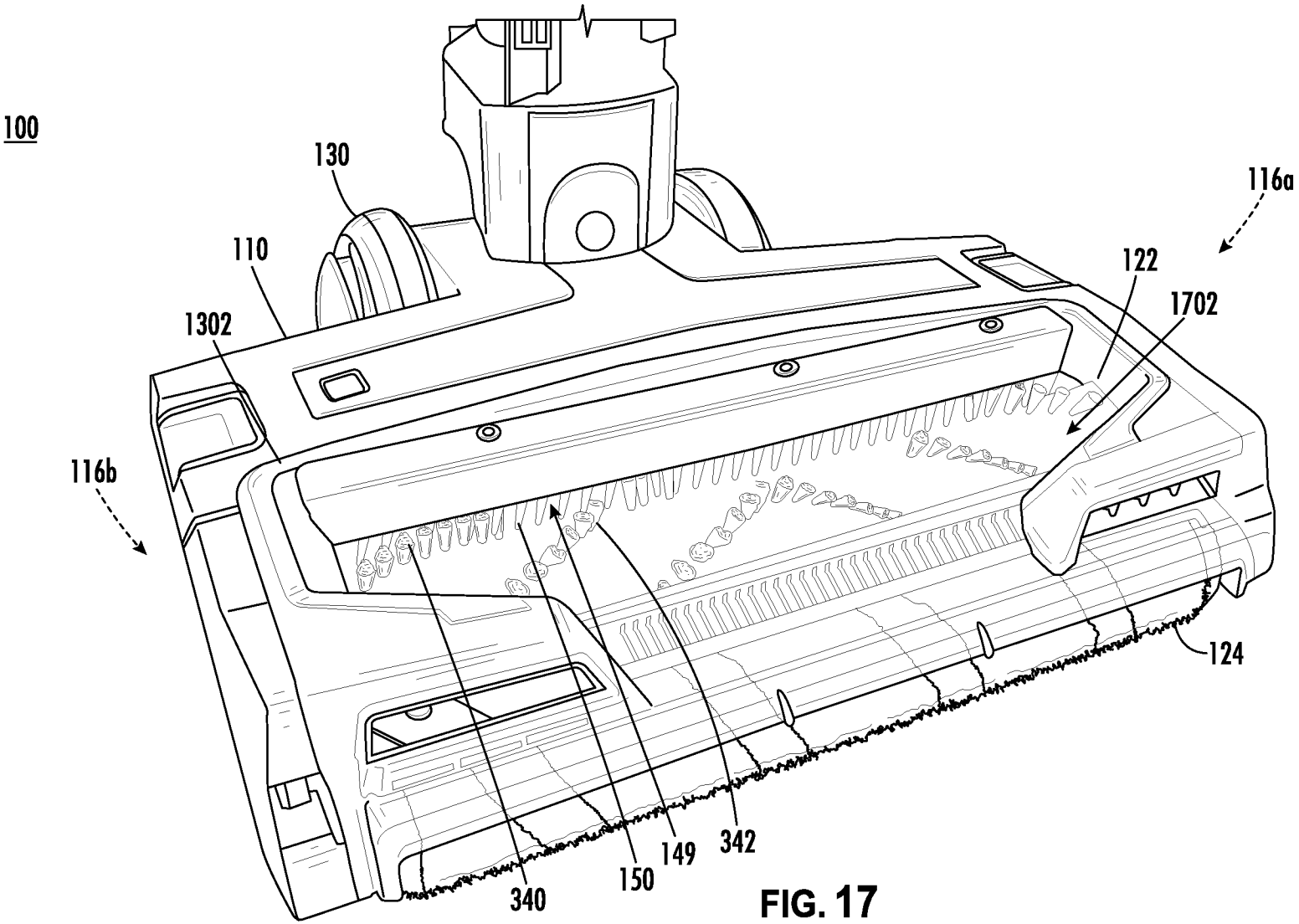
FIG. 17 is one example of a surface cleaning head with a removable panel having a combining unit in an active mode.

Turning now to FIG. 17, one example of a surface cleaning head 100 including an active mode panel 1302 having a combing unit 149 in the active position is generally illustrated. As can be seen, the plurality of teeth 150 of the combing unit 149 extend from the active mode panel 1302 and contact the agitator 122, 124. The plurality of teeth 150 may contact the bristles 340 and/or the flexible sidewall 342 as described herein. A portion 1702 of the active mode panel 1302 may be formed from a transparent and/or semi-transparent material such that the interaction between the combing unit 149 and the agitator 122, 124 may be seen by the user while using the vacuum in normal use.

Figure 18:
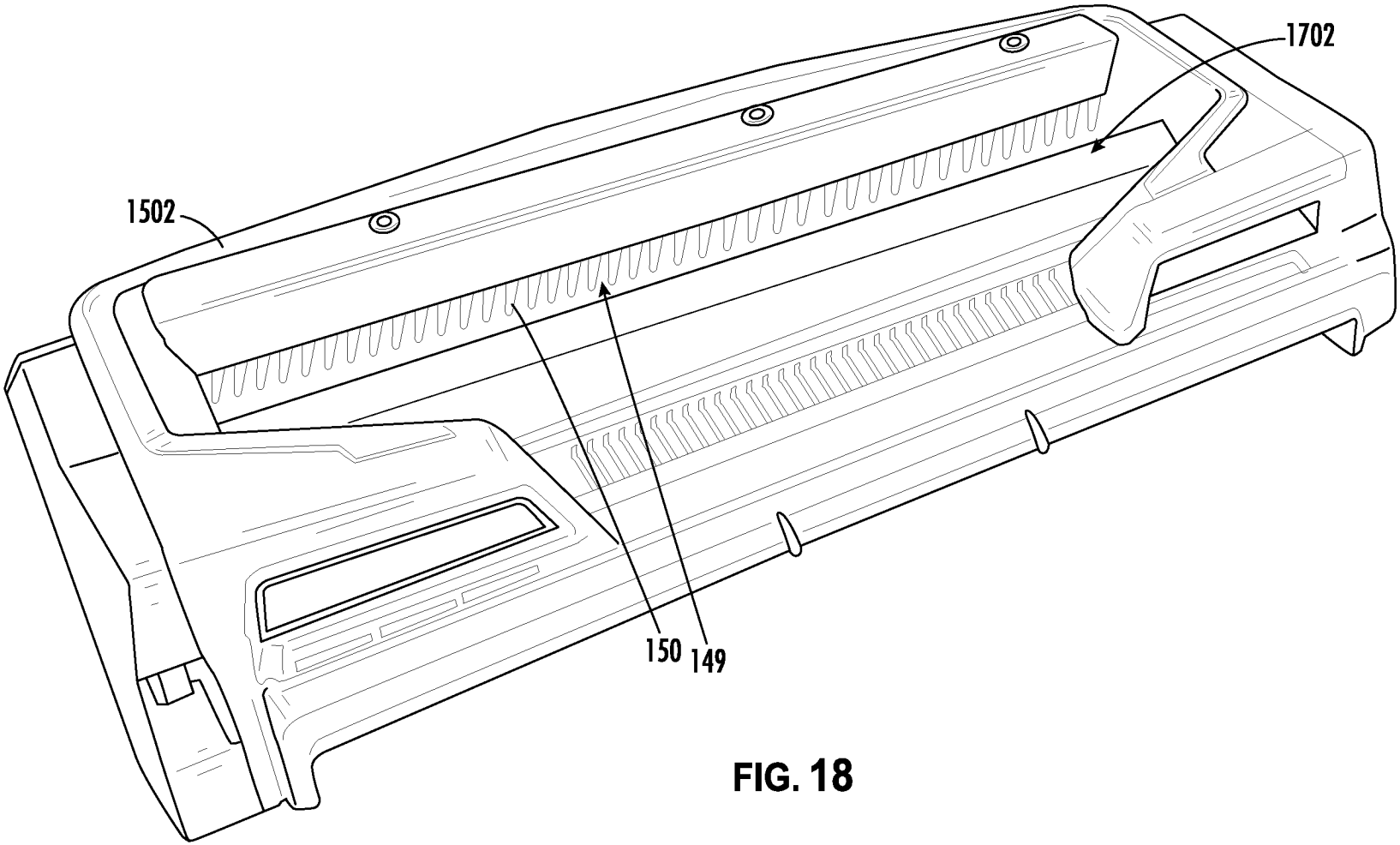
FIG. 18 is one example of a removable panel surface having a combing unit in the inactive mode.

With reference to FIG. 18, one example of an inactive mode panel 1502 having a combing unit 149 in the inactive position is generally illustrated. In particular, the teeth 150 of the combing unit 149 have been configured (e.g., positioned and/or modified) such that the agitator 122, 124 does not contact the combining unit 149 when the inactive mode panel 1502 is secured to the housing 110 and the agitator 122, 124 rotates within the suction conduit 128. The inactive mode panel 1502 may optionally include indicia to identify that the inactive mode panel 1502 for use in the inactive mode. For example, the inactive mode panel 1502 may include a different color or the like to differentiate it from the active mode panel 1302.

Figure 19:
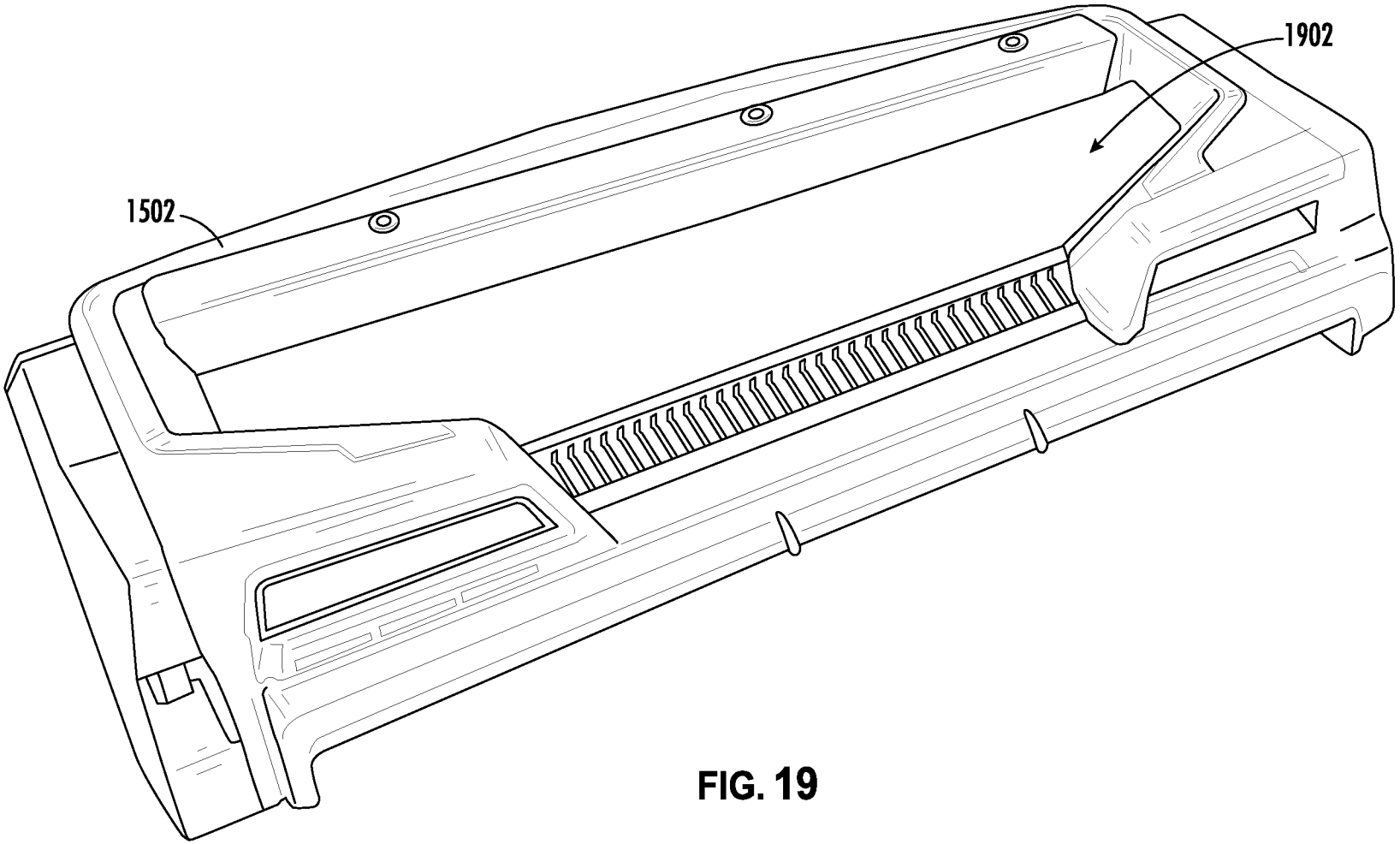
FIG. 19 is one example of a removable panel surface without a combing unit in the inactive mode.

FIG. 19 generally illustrates another example of an inactive mode panel 1502. The inactive mode panel 1502 does not include a combing unit 149. Optionally, the inactive mode panel 1502 may include a portion 1902 formed from a transparent and/or semi-transparent material such that the rotation of the agitator 122, 124 may be seen by the user while using the vacuum in normal use. According to one example, the transparent and/or semi-transparent portion 1902 of the inactive mode panel 1502 may be the same size and/or shape as the transparent and/or semi-transparent portion 1702 of the active mode panel 1302.

Figure 20:
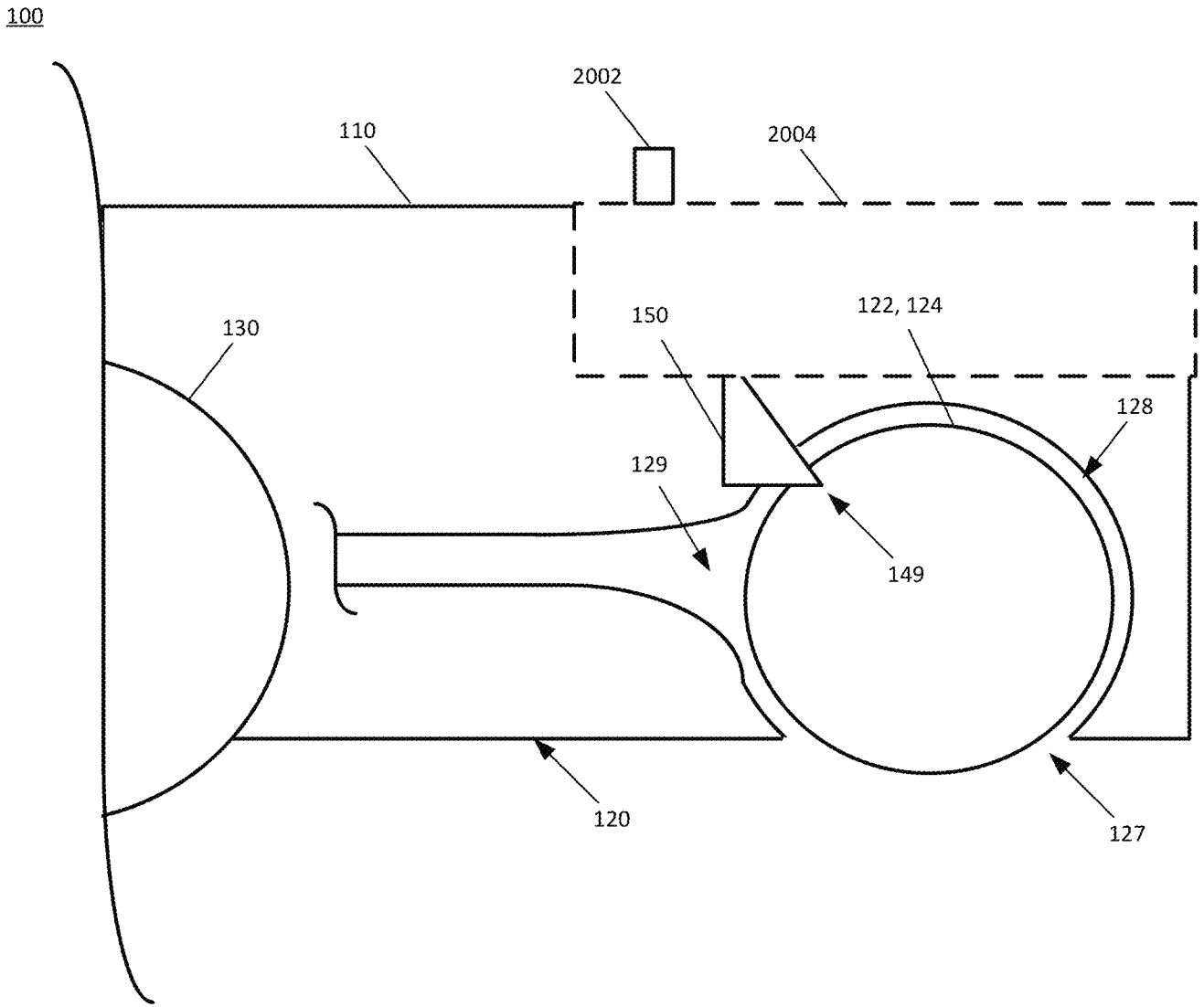
FIG. 20 is one example of a surface cleaning head including a switch configured to toggle a combining unit between an active mode and an inactive mode.

Turning now to FIG. 20, another example of surface cleaning head 100 including a combining unit which can be toggled between an active mode and an inactive mode is generally illustrated. The surface cleaning head 100 includes a housing 110 including a suction conduit 128 having an opening 127 on the underside 120 of the housing 110. The suction conduit 128 is fluidly coupled to a dirty air inlet 129, which leads to a suction motor (not shown) either in the surface cleaning head 100 or another location in the vacuum. While the illustrated surface cleaning head 100 includes a single agitator 122, 124 at least partially disposed within the suction conduit 128, it should be appreciated that the surface cleaning head 100 may include multiple rotating agitators (for example, a brush roll 122 and a leading roller 124) disposed in one or more agitation chambers. The surface cleaning head 100 may also include one or more wheels 130 and/or additional features not shown, but described herein.

The surface cleaning head 100 may also include one or more combing units/debriders 149 each having a series of combing protrusions (also referred to as debriding protrusions) 150 configured to contact one or more of the agitators (e.g., brush roll 122 and/or the leading roller 124). One example of the combing unit 149 as shown in greater detail in FIGS. 4-5. The combing protrusions 150 may be configured to remove debris (such as, but not limited to, hair, string, and the like) that may be wrapped around and/or entrapped/entrained in/on the agitator 122, 124 as the surface cleaning head 100 is being used. The combing unit 149 may be secured to any part of the surface cleaning head 100. For example, the combing unit 149 may be secured to the housing 110 and/or to a removable panel 2004 such that a portion of the combing unit 149 contacts an agitator 122, 124 during the active mode as the agitator 122, 124 rotates within the agitation chamber/suction conduit 128.

Figure 21:
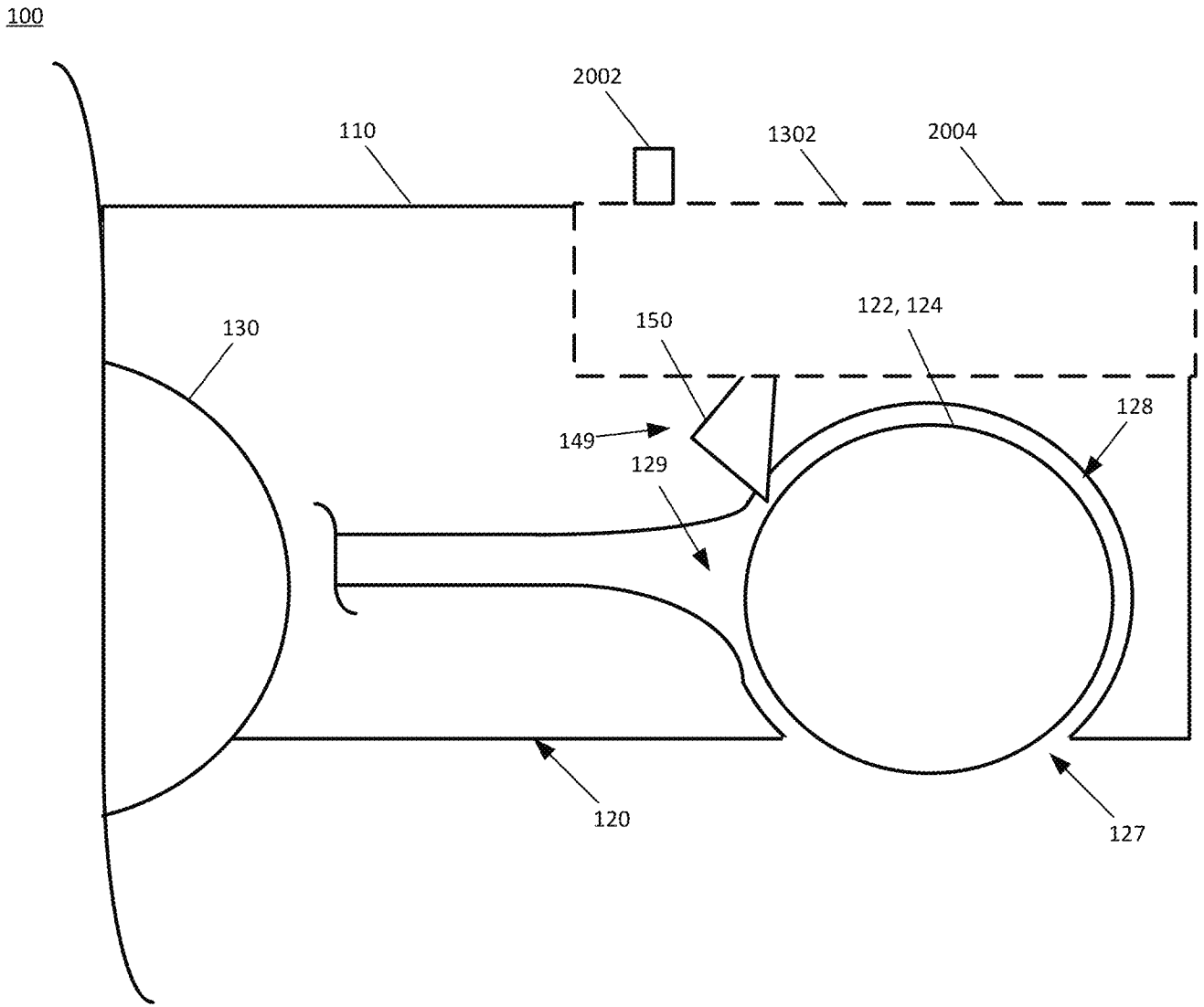
FIG. 21 is one example of a surface cleaning head including a switch configured to position a combining unit in an inactive mode.

The surface cleaning head 100 may also include one or more switch 2002 configured to toggle the combing unit 149 between an active mode (as generally illustrated in FIG. 20) and an inactive mode (as generally illustrated in FIG. 21). The switch 2002 may be secured to any part of the surface cleaning head 100. For example, the switch 2002 may be secured to the housing 110 and/or to the removable panel 2004.

The switch 2002 may be configured to cause the combing unit 149 to remain in the selected mode (e.g., either the active mode or inactive mode) until a switch activation force is applied to select the other mode. In this manner, the combing unit 149 may be locked in the active mode and inactive mode, and remain in the selected mode.

Alternatively, the switch 2002 may be configured to cause the combing unit 149 to default in one mode unless the switch 2002 an activation force is applied to the switch 2002. By way of example, the switch 2002 may be configured to cause the combing unit 149 to remain in the inactive mode (i.e., the default setting). Upon applying an activation force to the switch 2002, the combing unit 149 may be moved from the inactive mode to the active mode. Once the switch activation force is terminated (e.g., a user and/or actuator stops urging the switch 2002), the switch 2002 may be configured to automatically revert back to the inactive mode. The automatic return to the default setting may be provided by, for example, a return spring or the like. Of course, the default setting may alternatively be the active setting.

Figure 22:
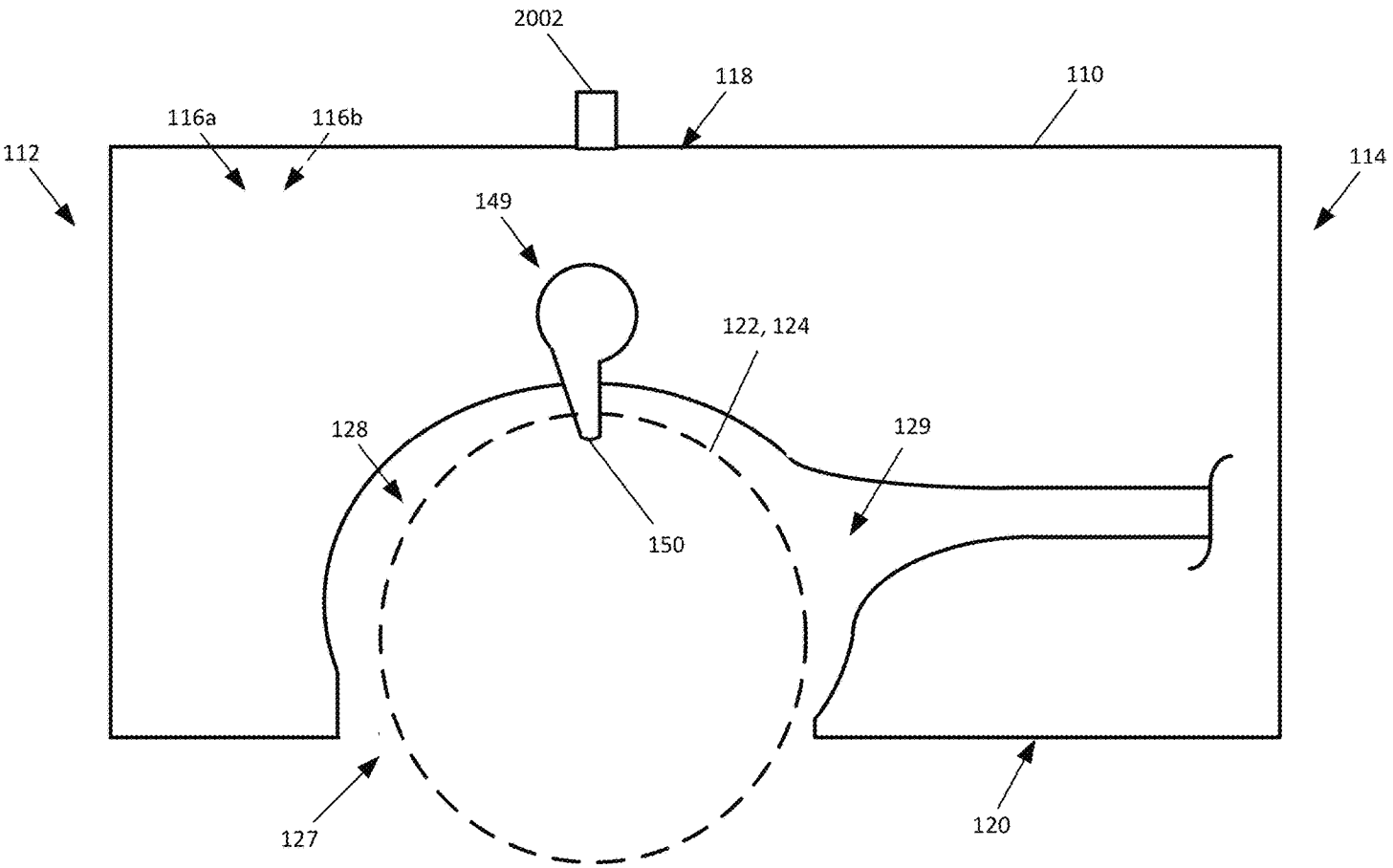
FIG. 22 is one example of a surface cleaning head including a combining unit in an active mode and a switch configured to move the combing unit linearly.
Figure 23:
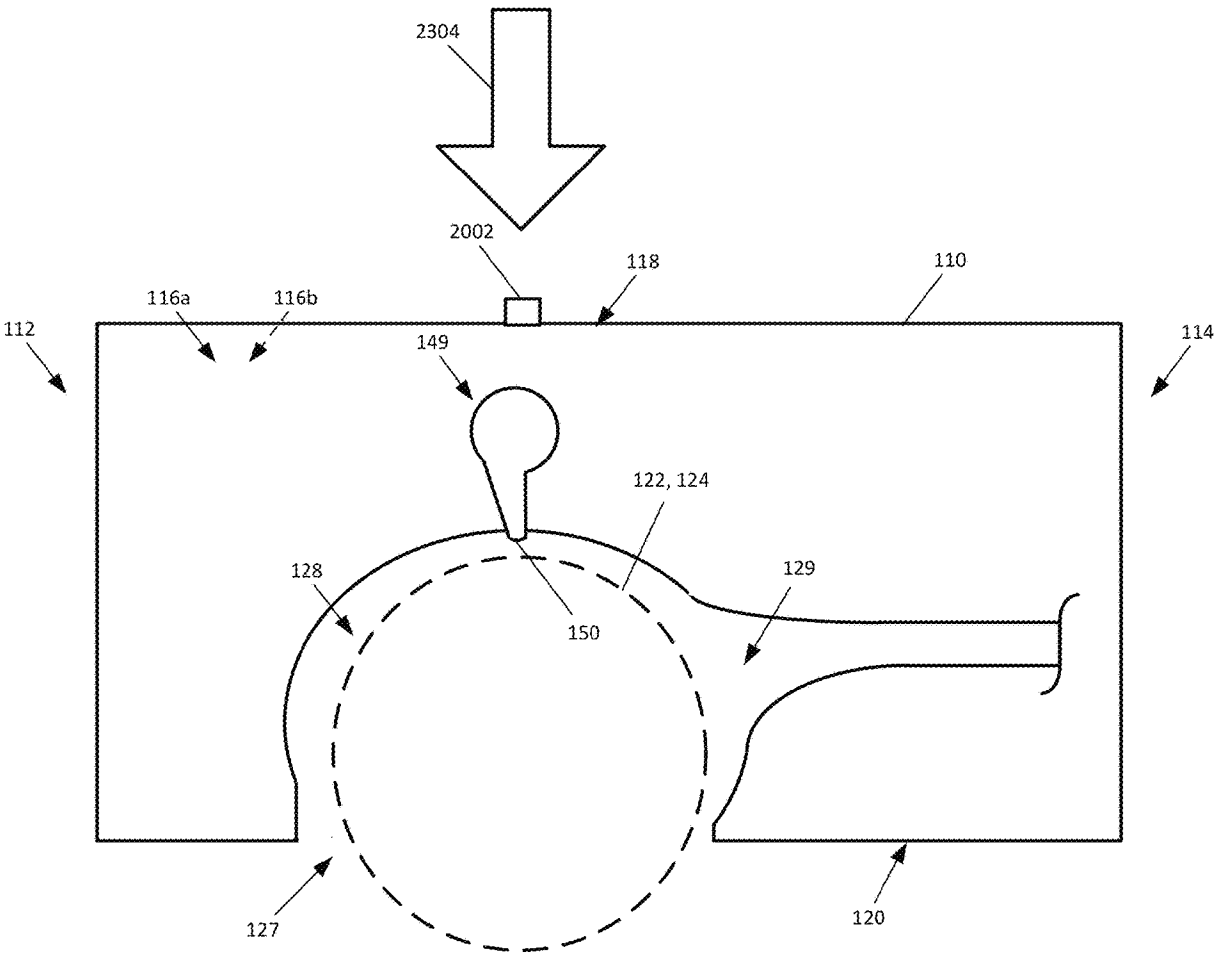
FIG. 23 is one example of a surface cleaning head of FIG. 22 in an inactive mode.

According to one example, activation of the switch 2002 is configured to cause the combing unit 149 (and in particular the teeth 150) to move linearly between the active position shown in FIG. 22 and the inactive position as shown in FIG. 23. For example, the switch 2002 may be depressed downwardly from the upper surface 118 towards the underside 120 of the housing 110 as generally illustrated by arrow 2304 in FIG. 23. Alternatively (or in addition), the switch 2002 may be moved generally left/right (e.g., generally towards the left and right sides 116*a*, 116*b*) and/or front/back (e.g., generally towards the front side 112 and back side 114).

In the illustrated embodiment, activation of the switch 2002 is configured to cause the combing unit 149 (and in particular the teeth 150) to move linearly away from the agitator 122, 124. For example, activation of the switch 2002 is configured to cause the combing unit 149 to move towards the upper surface 118 of the housing 110. It should be appreciated, however, that activation of the switch 2002 may cause the combing unit 149 to move linearly away from the agitator 122, 124 in any direction. Moreover, activation of the switch 2002 may be configured to cause the combing unit 149 to move linearly in any direction from the inactive position to the active position.

Figure 24:
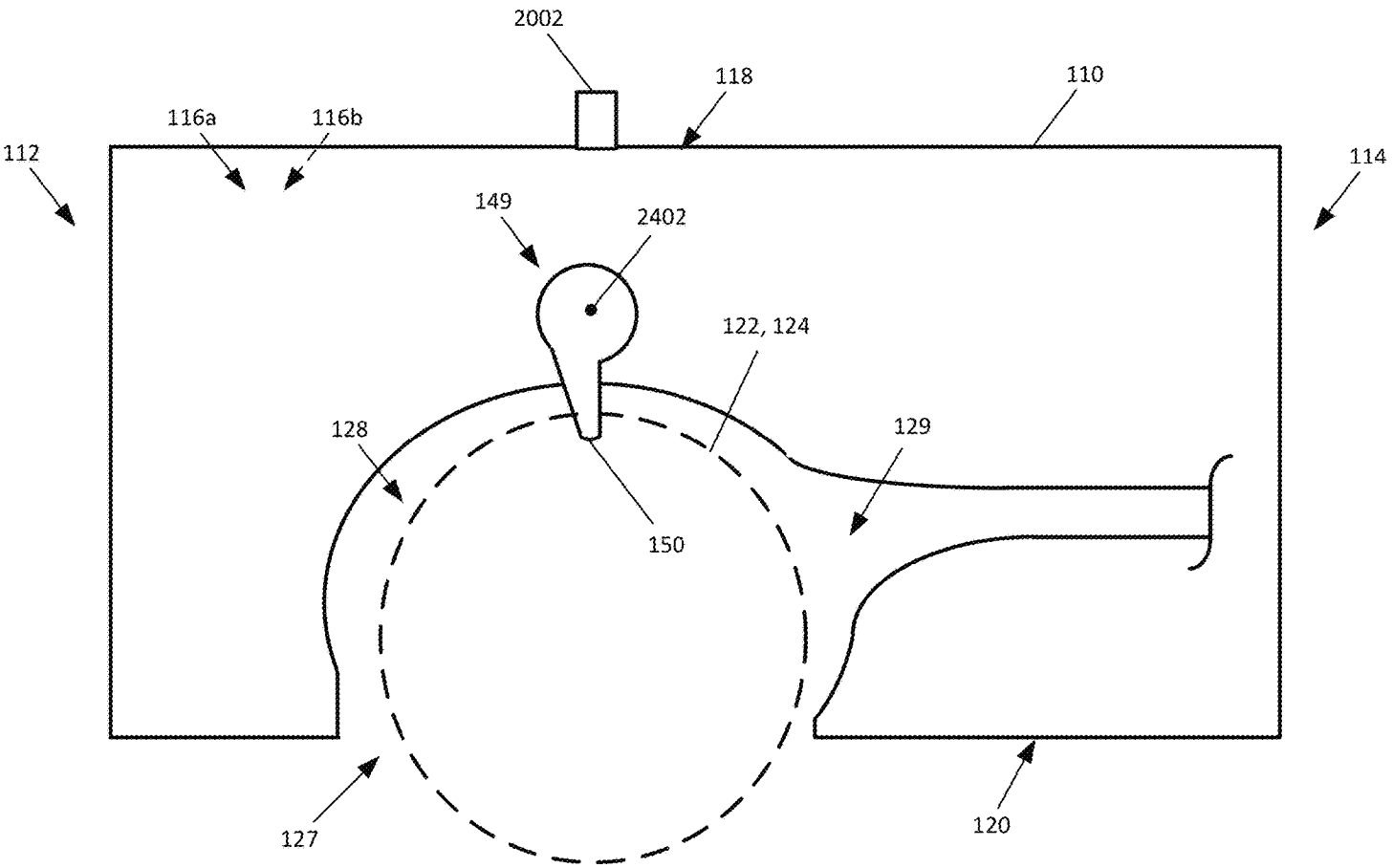
FIG. 24 is one example of a surface cleaning head including a combining unit in an active mode and a switch configured to pivot the combing unit.
Figure 25:
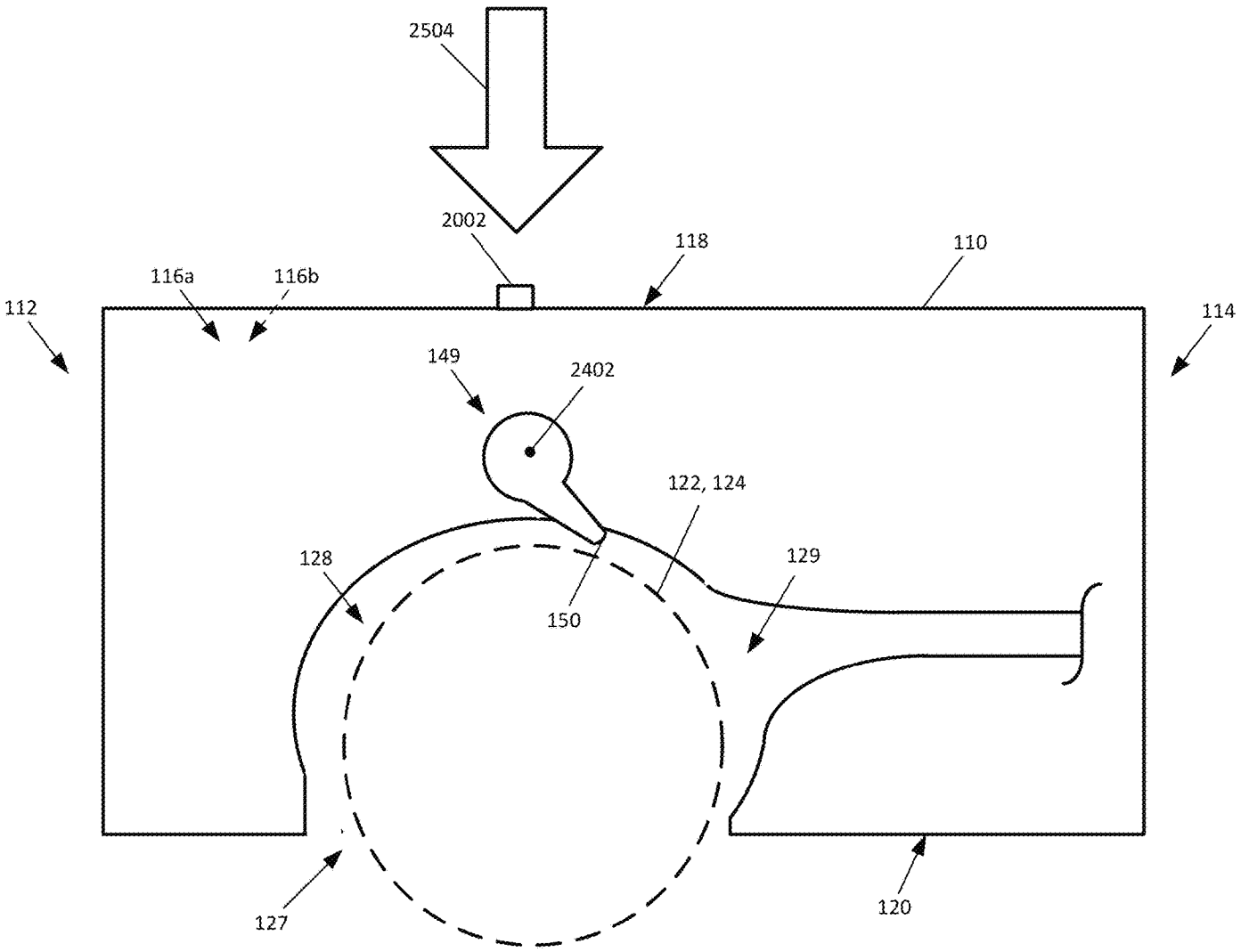
FIG. 25 is one example of a surface cleaning head of FIG. 24 in an inactive mode.
Figure 26:
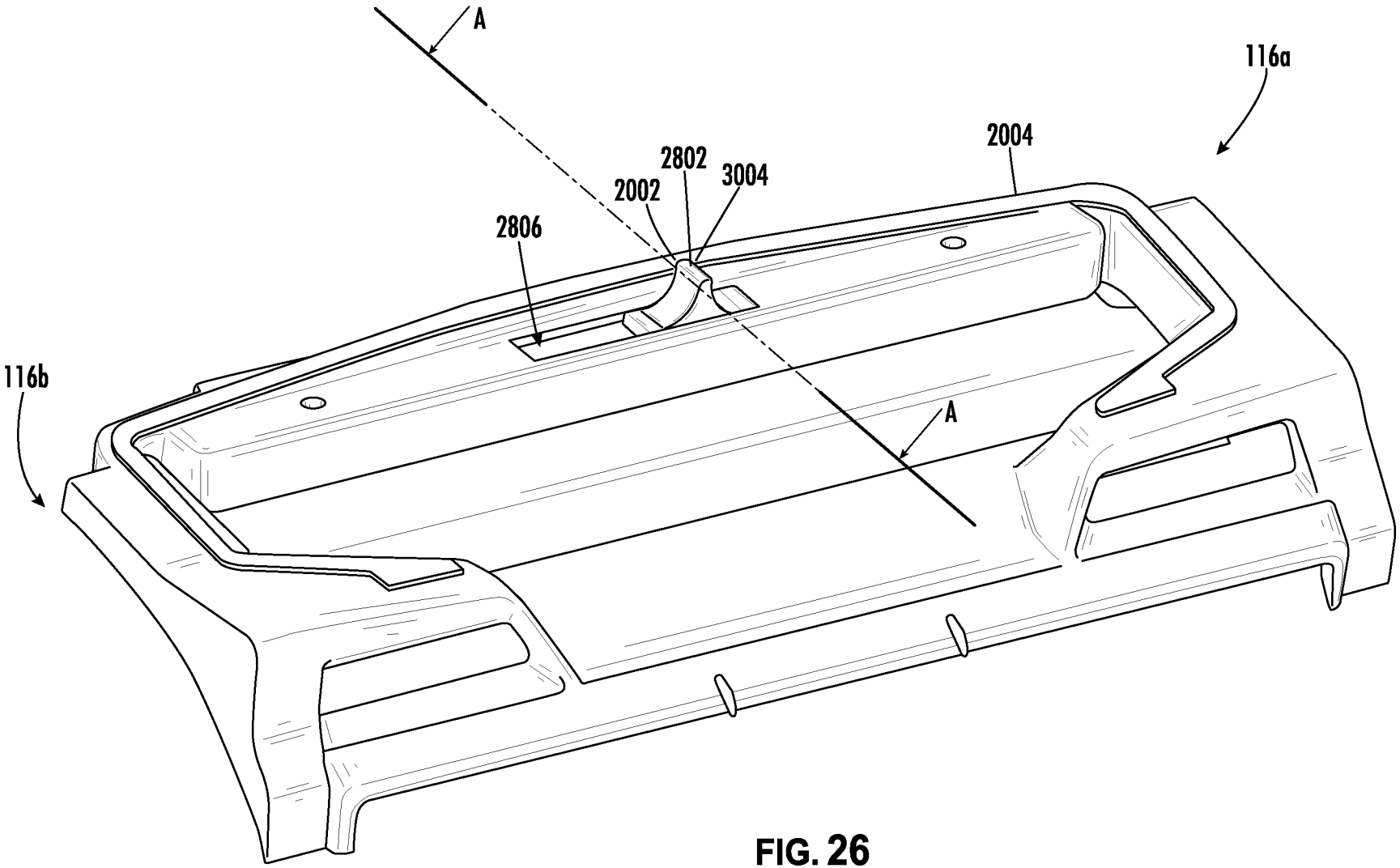
FIG. 26 is one example of a removable panel including a combining unit and a switch configured to move the combing unit linearly.

According to one example, activation of the switch 2002 is configured to cause the combing unit 149 (and in particular the teeth 150) to rotate about a pivot axis 2402 between the active position shown in FIG. 24 and the inactive position as shown in FIG. 26. For example, the switch 2002 may be depressed downwardly from the upper surface 118 towards the underside 120 of the housing 110 as generally illustrated by arrow 2504 in FIG. 25. Alternatively (or in addition), the switch 2002 may be moved generally left/right (e.g., generally towards the left and right sides 116*a*, 116*b*) and/or front/back (e.g., generally towards the front side 112 and back side 114).

Figure 27:
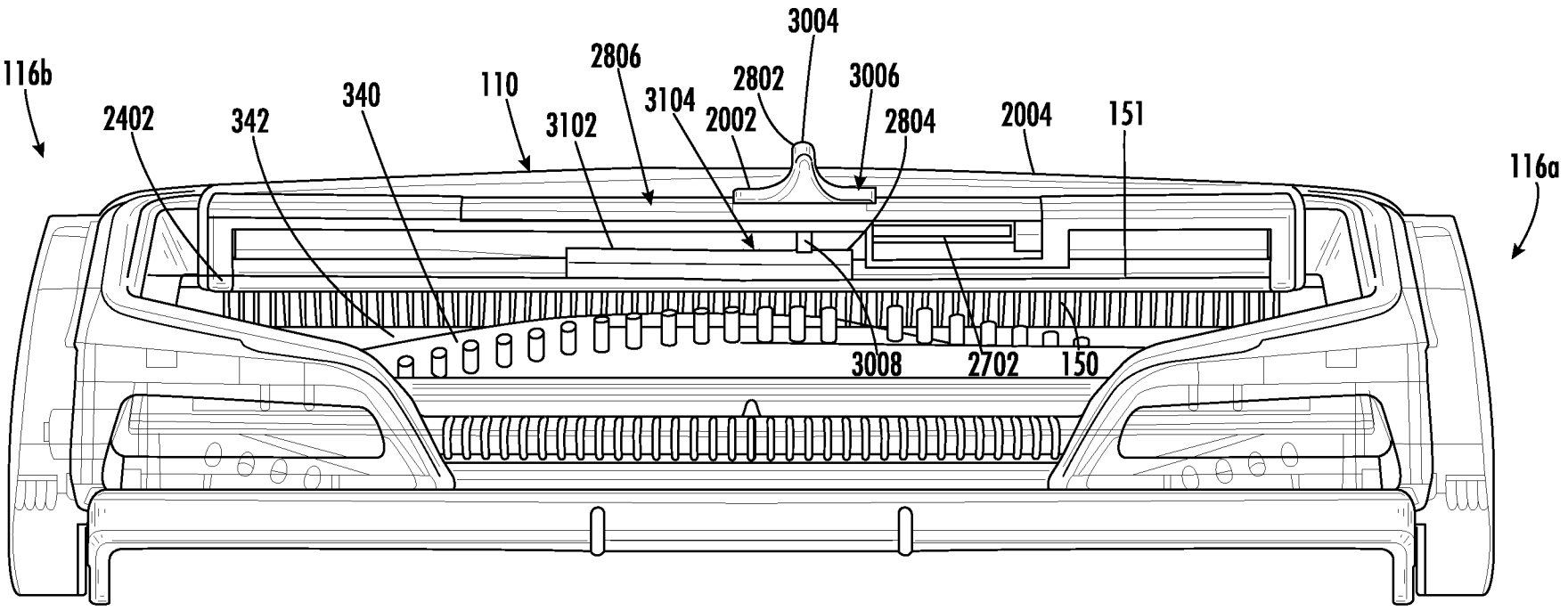
FIG. 27 is a transparent view of FIG. 26.

Turning now to FIGS. 26-27, one example of a switch 2002 configured to cause the combing unit 149 (and in particular the teeth 150) to rotate about a pivot axis 2402 between the active position and the inactive position is generally illustrated. In the illustrated example, the switch 2002 and the combing unit 149 are both part of a removable panel 2004 which is configured to be removable coupled to the housing 110 (not shown) as described herein. As such, removal of the panel 2004 from the housing 110 simultaneously removes both the switch 2002 as well as the combing unit 149. It should be appreciated, however, that the switch 2002 and/or the combing unit 149 may be coupled to any part of the surface cleaning head 100.

Figure 28:
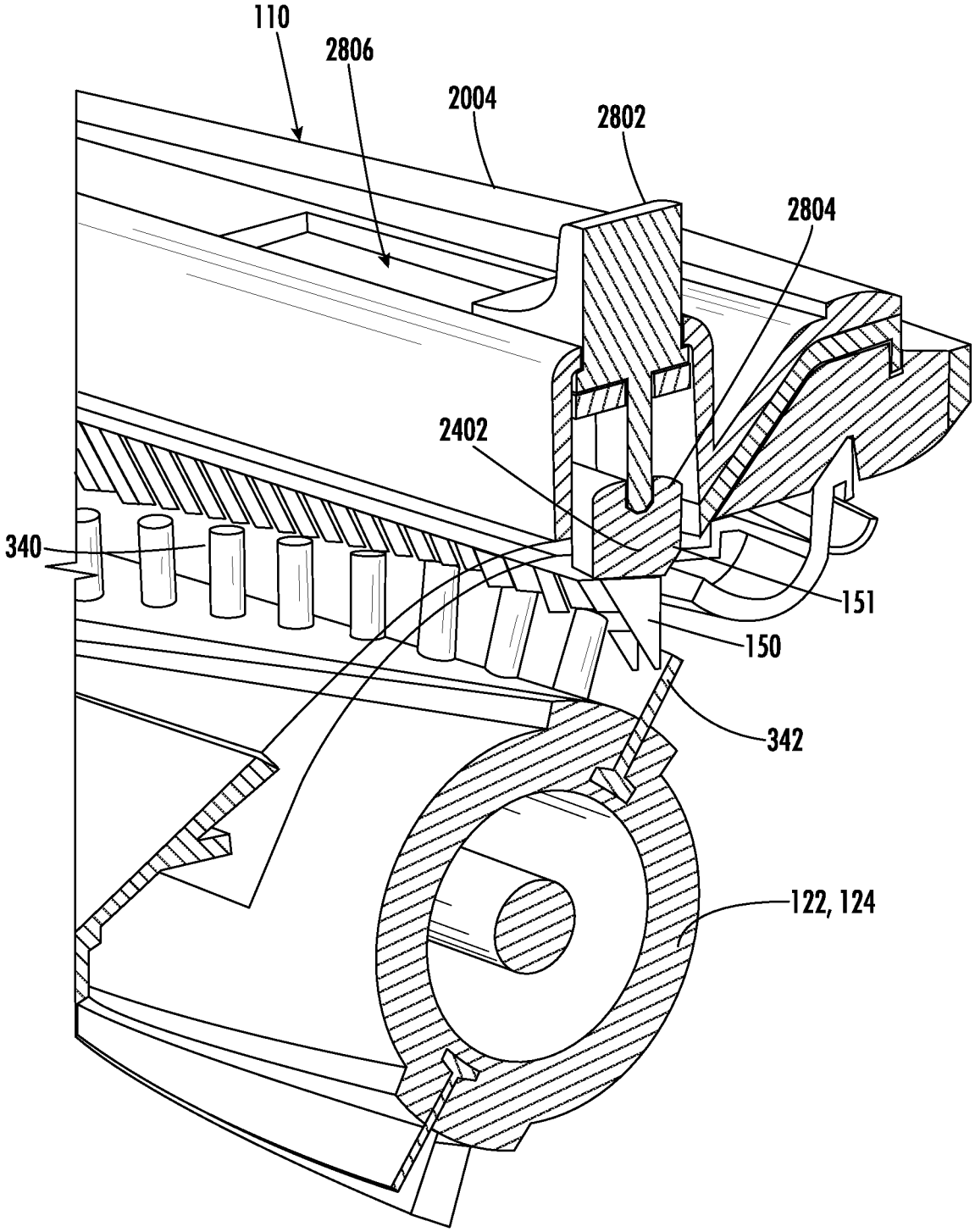
FIG. 28 is a cross-sectional view of FIG. 26 taken along lines A-A.
Figure 29A:
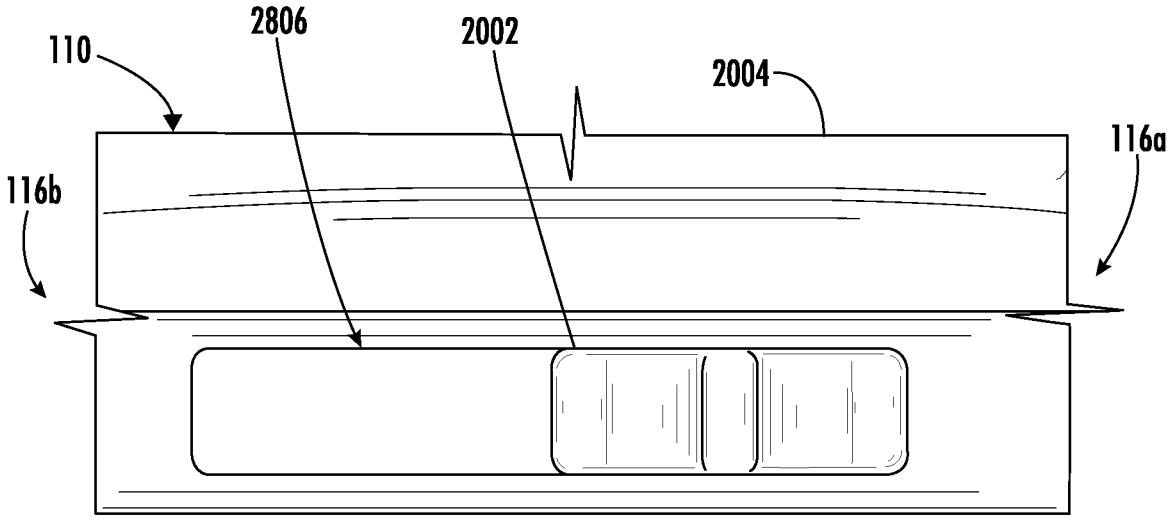
FIGS. 29A and 29B are close-up views of the switch and slot of FIG. 26.
Figure 29B:
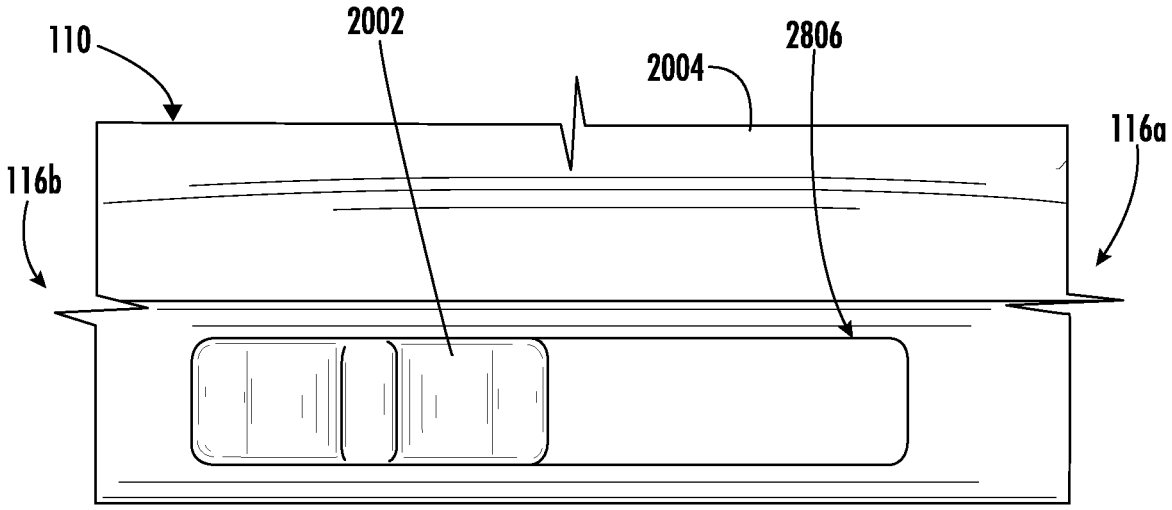

With reference to FIG. 28, the switch 2002 may include an actuation tab 2802 configured to engage a cam 2804. The actuation tab 2802 may be configured to move left/right (e.g., between the left and right sides 116*a*, 116*b* of the housing 110) when coupled to the housing 110 as generally illustrated in FIGS. 29A, 29B. For example, the actuation tab 2802 may slide within a groove or slot 2806 formed in the housing 110 (e.g., but not limited to, in the removable panel 2004). The actuation tab 2802 is configured to be coupled to the cam 2804 such that linear movement of the actuation tab 2802 (e.g., linear left/right movement) causes the cam 2804 to rotate about the pivot axis 2402. The cam 2804 may be coupled to the combing unit 149 such that rotation of the cam 2804 about the pivot axis 2402 also causes rotation of the combing unit 149 about the pivot axis 2402. The cam 2804 may therefore translate the linear movement of the actuation tab 2802 into rotational movement of the combing unit 149.

Figure 30:
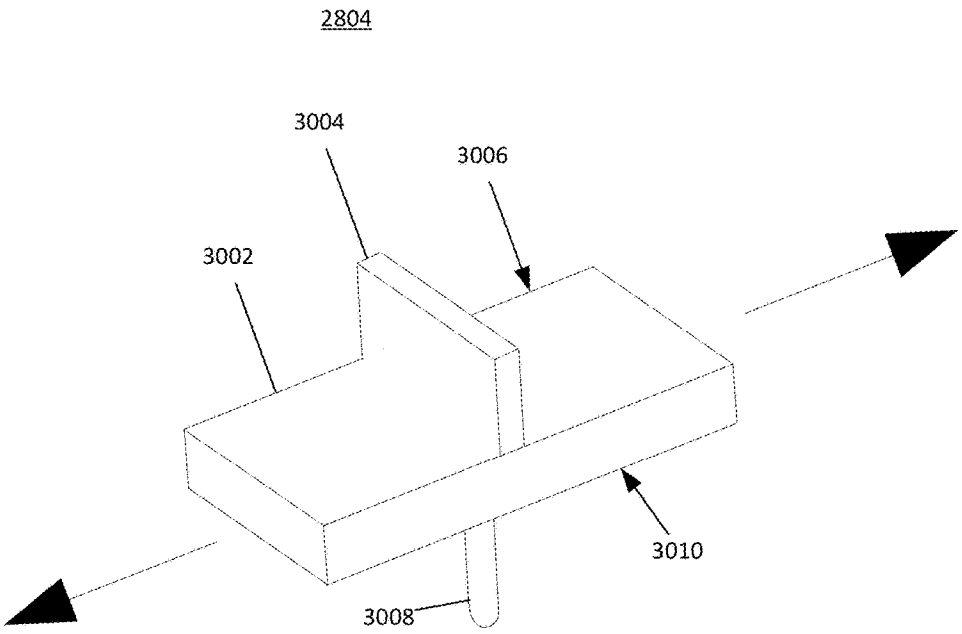
FIG. 30 is a perspective view of one example of a switch body of a switch.

One example of the actuation tab 2802 is shown in FIG. 30. The actuation tab 2802 may include a body 3002 configured to be at least partially received in the slot 2806 in the housing 110. The actuation tab 2802 may include one or more protrusions, ribs, slots, or the like 3004. The protrusion 3004 may extend from/within an upper surface 3006 of the body 3002 (i.e., a surface that is exposed to the user in normal use) and may be configured to allow a user to move the actuation tab 2802 relative to the housing 110. In addition, the actuation tab 2802 may also include one or more posts or fingers 3008. The fingers 3008 may extend from a lower surface 3010 of the body 3002 and may be configured to engage with the cam 2804 such that movement of the actuation tab 2802 causes rotation of cam 2804.

Figure 31:
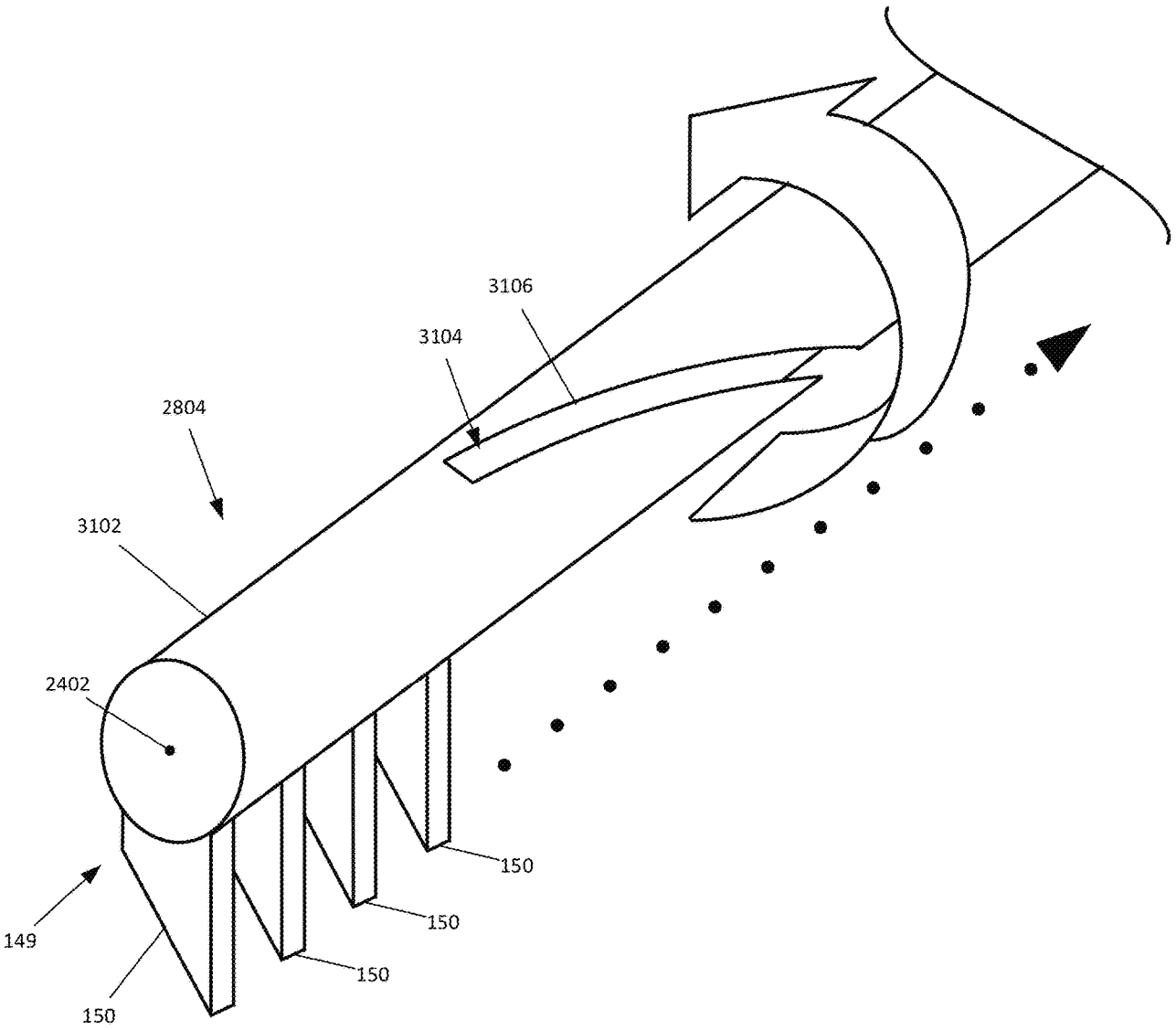
FIG. 31 is a perspective view of one example of a cam of a switch coupled to a combing unit.

One example of the cam 2804 is generally illustrated in FIG. 31. The cam 2804 may be coupled to the combing unit 149 (e.g., coupled to the back support 151). Alternatively, the cam 2804 may be formed as a single unit with at least a portion of the combing unit 149 (e.g., the back support 151). The cam 2804 may include body 3102 including one or more camming surface 3104. According to one example, the cam 2804 may include a barrel cam including a slot 3106 configured to receive at least a portion of the finger 3008 of the actuation tab 2802. For example, the slot 3106 may include a generally helical slot, and may include camming surfaces 3104 configured to engage with the finger 3008 of the actuation tab 2802 to cause rotation about the pivot axis 2402. The degree of rotation about the pivot axis 2402 may depending on the intended application. For example, movement of the actuation tab 2802 within the slot 3106 may cause the cam 2804 and combing unit 149 to rotate at least 10 degrees about the pivot axis 2402. According to another example, the cam 2804 and combing unit 149 may rotate at least 20 degrees, at least 25 degrees, at least 30 degrees, at least 45 degrees, at least 60 degrees, and/or at least 90 degrees about the pivot axis 2402, including all values and ranges therein. The actuation tab 2802 may travel within the slot 2806 up to 60 mm. For example, the actuation tab 2802 may travel within the slot 2806 up to 50 mm, up to 40 mm, up to 30 mm, and/or up to 20 mm, including all values and ranges therein.

It should be appreciated that while the actuation tab 2802 has been shown with the finger 3008 and the combing unit 149 has been shown with the cam 2804, the arrangement of the finger 3008 and cam 2804 relative to the actuation tab 2802 and the combing unit 149 may be reversed.

With reference to FIG. 27, the switch 2002 may optionally include one or more biasing devices 2702. The biasing devices 2702 may urge the switch 2002 to a default position/mode as described herein. For example, the biasing device 2702 may include one or more springs configured to urge the switch 2002 towards the inactive mode or towards the active mode. In practice, a user would apply a switch activation force to move the switch 2002 from the default position/mode to the opposite position/mode. The switch activation force may therefore be in excess of the switch activation force. When the switch activation force is terminated, the switch 2002 may automatically revert back to the default position/mode.

Optionally, the biasing device 2702 may be selected to ensure that a sufficient force is applied to cause the combing unit 149 to remain in contact with the agitator 122, 124 during rotation of the agitator 122, 124 such that the combing unit 149 removes debris from the agitator 122, 124 while the agitator 122, 124 rotates.

Figure 32A:
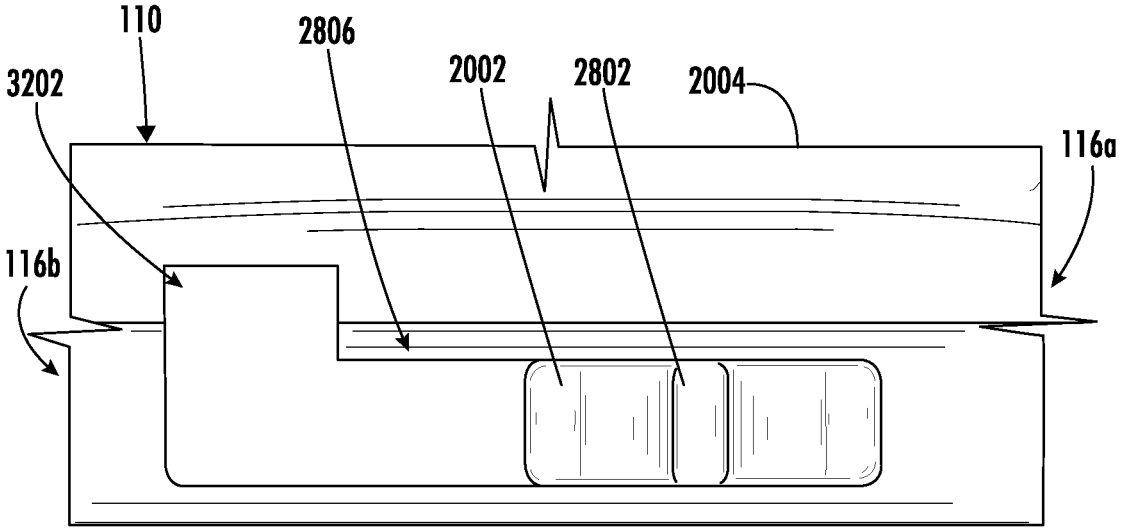
FIGS. 32A and 32B are close-up views another example of a slot and switch.
Figure 32B:
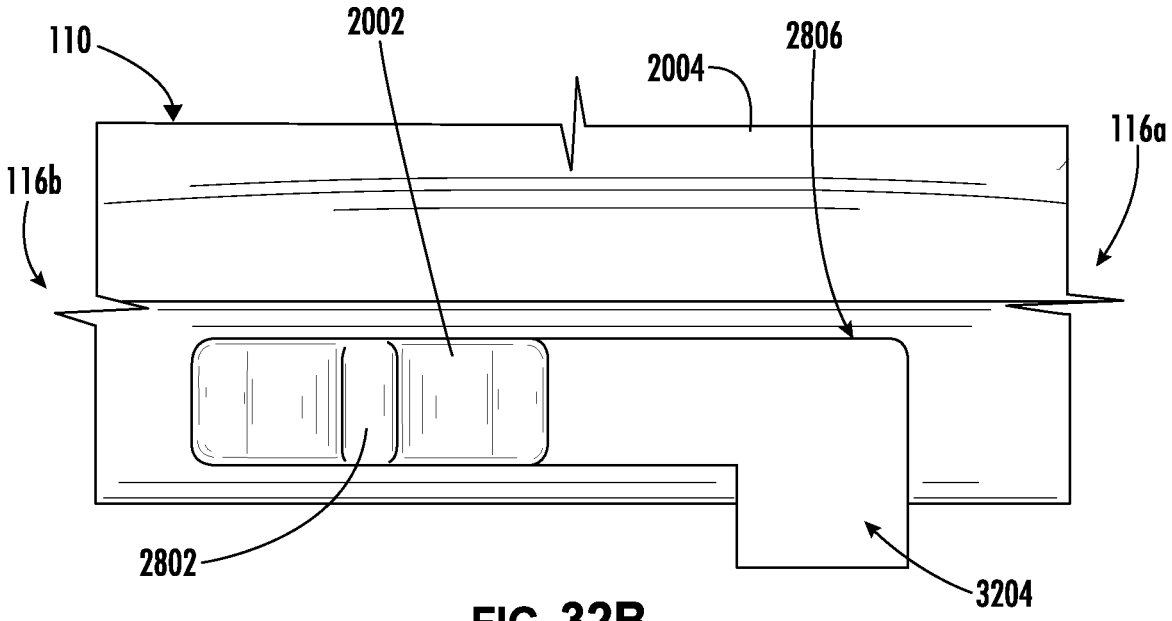

Optionally, the switch 2002 may be configured to remain in one or more of the selected positions/modes until an activation force is applied. For example, the slot 2806 may be configured with one or more retaining regions. Non-limiting examples of retaining regions 3202, 3204 are generally illustrated in FIGS. 32A and 32B. For example, the slot 2806 may include an active mode retaining region 3202 disposed proximate a first end of the slot 2806 and/or an inactive mode retaining region 3204 disposed proximate a second, opposite end of the slot 2806. The slot 2806 may be configured to allow the actuation tab 2802 to be moved into one or more of the retaining regions 3202, 3204 and retained therein. For example, the size and shape of the retaining regions 3202, 3204 may be selected to retain the actuation tab 2802. Alternatively, a retaining device (such as, but not limited to, a latch, catch, clip, or the like) may be provided to retain the actuation tab 2802 in the active and/or inactive mode. The actuation tab 2802 may remain in the selected mode until the actuation tab 2802 is either manually moved from the retaining region 3202, 3204 and/or the retaining device is disconnected.

Figure 33:
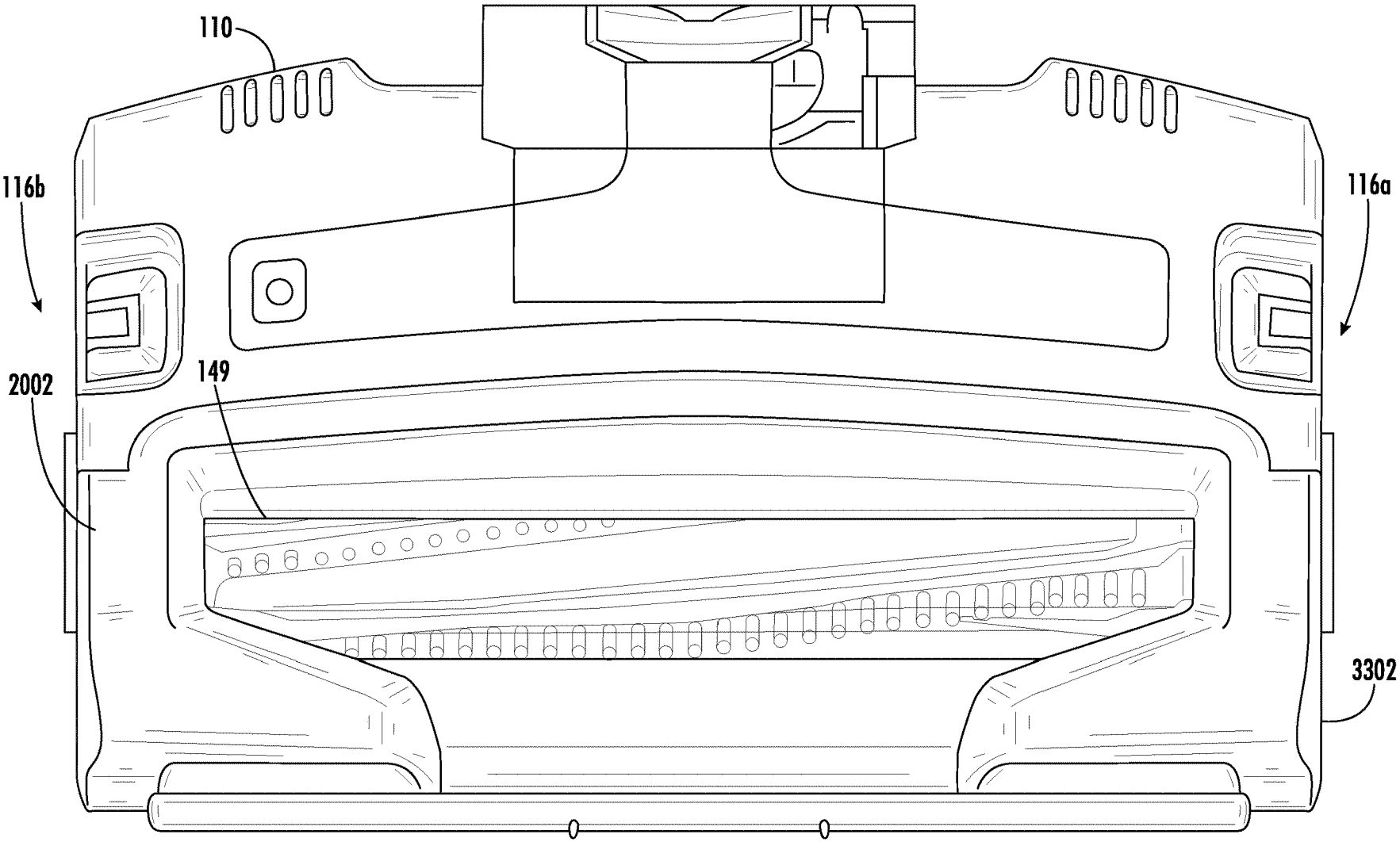
FIG. 33 is one example of a surface cleaning head including a combining unit in a switch coupled to the housing.

Turning now to FIG. 33, another example of a switch 2002 is generally illustrated. The switch 2002 may be coupled to the housing 110 rather than to a removable panel 3302. For example, the switch 2002 and the combing unit 149 may be permanently coupled to the housing 110. The switch 2002 may be coupled to the combing unit 149 using one or more linkages and/or gears such that activation of the switch 2002 causes the combing unit 149 to move between the active position and inactive position.

Figure 34:
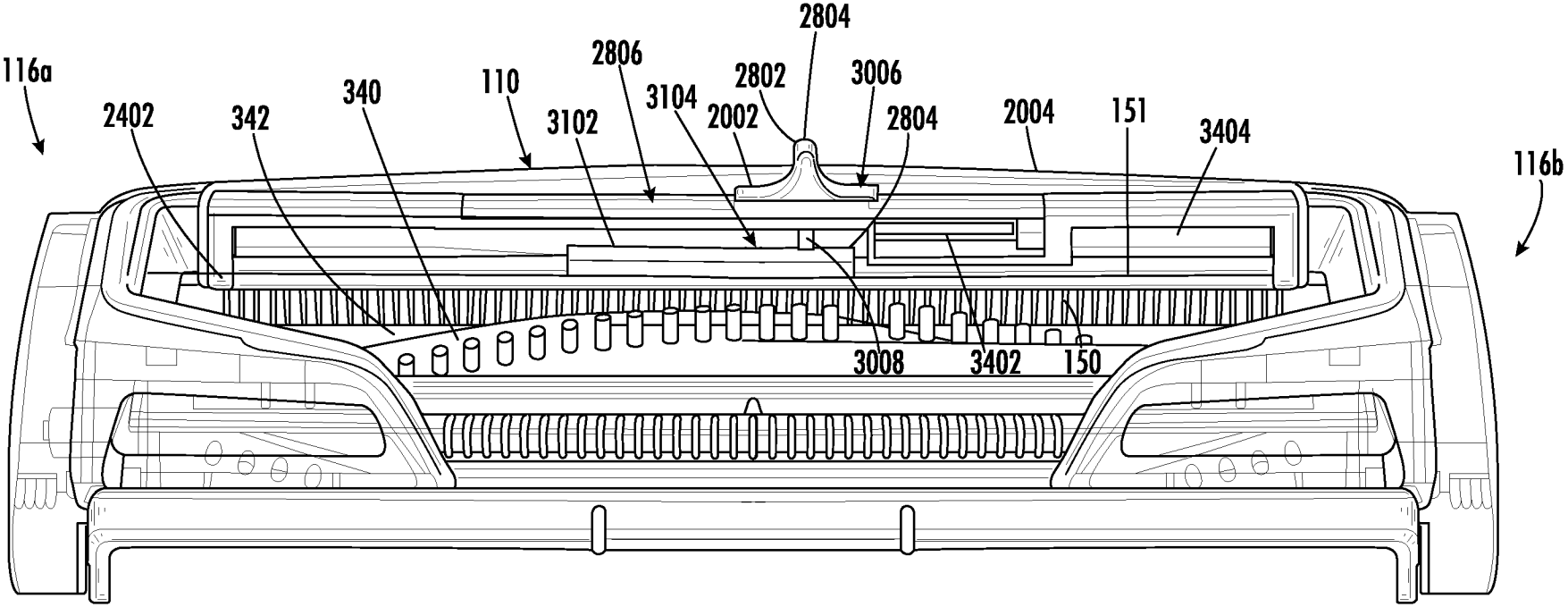
FIG. 34 is one example of a surface cleaning head including a combining unit, a switch, and an actuator configured to toggle the combing unit between an active mode and an inactive mode.

It should be appreciated that any of the switches 2002 described herein may be manually operated by a user and/or automatically operated by the vacuum device. For example, the surface cleaning head 100 may include one or more actuators 3402 as generally illustrated in FIG. 34. The actuator 3402 may be configured to cause the switch 2002 to move between the active mode and inactive mode, for example, based on one or more conditions. For example, the actuator 3402 may alternate between the modes periodically (e.g., every 30 seconds), upon the occurrence of one or more predefined events (e.g., upon powering on and/or off the vacuum cleaner), and/or in response to a sensor 3404. The sensor 3404 may be configured to sense the amount of debris on the agitator 122, 124, and cause the actuator 3402 to move the switch 2002 from the inactive mode to the active mode upon exceeding a threshold value. The sensor 3404 may include a load sensor, optical sensor, or the like.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A cleaning apparatus comprising:

a housing;

at least one agitator configured to be rotatably coupled to said housing;

a combing unit comprising a plurality of spaced teeth configured to contact said agitator for preventing build up and removing debris;

a switch including a switch body, a post configured to extend from said switch body, and a cam coupled to said combing unit, said switch configured to cause said combing unit to move between an active mode in which said plurality of spaced teeth are configured to contact said agitator for preventing build up and removing debris, and an inactive mode in which said plurality of spaced teeth are configured to not contact said agitator, wherein said cam comprises a generally helical slot coupled to said combing unit, said generally helical slot configured to receive a portion of said post; and a removable panel configured to be removably coupled to said housing, said removable panel including a slot;

wherein said post is configured to engage said cam such that linear movement of said switch body in said slot causes said rotational movement of said combing unit about a pivot axis between said active mode and said inactive mode while said removable panel is coupled to said housing.

2. A cleaning apparatus comprising:

a housing having a left and a right side;

at least one agitator configured to be rotatably coupled to said housing between said left and said right side of said housing;

a combing unit comprising a plurality of spaced teeth configured to contact said agitator for preventing build up and removing debris;

a switch including a switch body, a post configured to extend from said switch body, and a cam coupled to said combing unit, said switch configured to cause said combing unit to move between an active mode in which said plurality of spaced teeth are configured to contact said agitator for preventing build up and removing debris, and an inactive mode in which said plurality of spaced teeth are configured to not contact said agitator; and a removable panel configured to be removably coupled to said housing, said removable panel including a slot extending laterally between said left and said lateral right side of said housing;

wherein said post is configured to engage said cam such that movement of said switch body in a lateral direction within said slot causes said rotational movement of said combing unit about a pivot axis between said active mode and said inactive mode while said removable panel is coupled to said housing.

3. The cleaning apparatus of claim 2, wherein said cam comprises a generally helical slot coupled to said combing unit, said generally helical slot configured to receive a portion of said post.

4. The cleaning apparatus of claim 2, wherein said slot includes at least one retention region, said retention region configured to maintain said switch in a selected one of said active or inactive modes.

5. The cleaning apparatus of claim 2, wherein said switch further includes an actuator configured to cause said combing unit to move between said active mode and said inactive mode.

6. The cleaning apparatus of claim 5, further comprising a sensor configured to cause said actuator to move said combing unit between said active mode and said inactive mode.

7. The cleaning apparatus of claim 2, wherein said switch further includes a biasing device configured to cause said combing unit to default to one of said active mode or said inactive mode.

8. The cleaning apparatus of claim 7, wherein said biasing device includes a spring.

* * * * *